US012613059B2

(12) United States Patent
Yu et al.

(10) Patent No.: US 12,613,059 B2
(45) Date of Patent: Apr. 28, 2026

(54) AIR CONDITIONER AND CONTROL METHOD THEREOF

(71) Applicant: Samsung Electronics Co., Ltd., Suwon-si (KR)

(72) Inventors: Seungcheon Yu, Suwon-si (KR); Youngjin Kim, Suwon-si (KR); Beomseok Seo, Suwon-si (KR); Sungjin In, Suwon-si (KR); Youngjun Choi, Suwon-si (KR); Dongsu Ha, Suwon-si (KR); Daechul Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 121 days.

(21) Appl. No.: 18/620,611

(22) Filed: Mar. 28, 2024

(65) Prior Publication Data

US 2024/0240846 A1 Jul. 18, 2024

Related U.S. Application Data

(63) Continuation of application No. PCT/KR2022/015861, filed on Oct. 18, 2022.

(30) Foreign Application Priority Data

Dec. 10, 2021 (KR) ..... 10-2021-0176518

(51) Int. Cl.
*F25B 49/02* (2006.01)
*F25B 40/02* (2006.01)
*F25B 41/31* (2021.01)

(52) U.S. Cl.
CPC ..... *F25B 49/02* (2013.01); *F25B 40/02* (2013.01); *F25B 41/31* (2021.01); *F25B 2700/2115* (2013.01)

(58) Field of Classification Search
CPC ..... F25B 49/02; F25B 41/31; F25B 40/02; F25B 2700/2115
See application file for complete search history.

(56) References Cited

U.S. PATENT DOCUMENTS 7,918,098 B2 4/2011 Ko et al.
2004/0261447 A1 12/2004 Matsuoka et al.
(Continued)

FOREIGN PATENT DOCUMENTS

CN 112797680 A * 5/2021 ..... F25B 45/00
JP 3823444 B2 * 9/2006
(Continued)

OTHER PUBLICATIONS

FOR1, Control device, method and system for automatically filling refrigerant and air conditioning equipment, 2020, Full Document (Year: 2020).*
(Continued)

*Primary Examiner* — Nael N Babaa
(74) *Attorney, Agent, or Firm* — Nixon & Vanderhye P.C.

(57) ABSTRACT

An air conditioner may include: a compressor; a flow path switching valve; a first flow path connecting an outlet of the compressor to the flow path switching valve; a first heat exchanger; a second flow path connecting the first heat exchanger to the flow path switching valve; a first refrigerant port fluidly connected to an indoor unit; a third flow path extending from the first heat exchanger to the first refrigerant port; a sub-cooler provided on the third flow path; a first expansion valve provided between the first heat exchanger and the sub-cooler on the third flow path; a second expansion valve provided between the sub-cooler and the first refrigerant port on the third flow path; a fourth flow path branched from a branch point of the third flow path, passing through the sub-cooler, and extending to an inlet of the compressor; a third expansion valve provided between the
(Continued)

sub-cooler and the branch point on the fourth flow path; a second refrigerant port fluidly connected to the indoor unit; a fifth flow path connecting the second refrigerant port to the flow path switching valve; and a sixth flow path connecting the flow path switching valve to an intake port of the compressor.

19 Claims, 10 Drawing Sheets

(56) References Cited

U.S. PATENT DOCUMENTS

| | | | | |
|---|---|---|---|---|
| 2014/0373564 | A1 | 12/2014 | Nishimura et al. | |
| 2019/0242603 | A1* | 8/2019 | Wei | F24F 11/41 |

FOREIGN PATENT DOCUMENTS

| | | | |
|---|---|---|---|
| JP | 4179595 | B2 | 9/2008 |
| JP | 2009127902 | A | 6/2009 |
| JP | 2010249452 | A | 11/2010 |
| JP | 4869117 | B2 | 11/2011 |
| JP | 5233960 | B2 | 7/2013 |
| JP | 2015209979 | A | 11/2015 |
| JP | 2017161193 | A | 9/2017 |
| JP | 2017172922 | A | 9/2017 |
| KR | 100395026 | B1 | 8/2003 |
| KR | 20090082733 | A | 7/2009 |
| KR | 101479458 | B1 | 1/2015 |
| KR | 101590884 | B1 | 2/2016 |
| KR | 101613205 | B1 | 4/2016 |
| KR | 20160096947 | A | 8/2016 |

OTHER PUBLICATIONS

FOR2, Air conditioner, 1997, Full Document (Year: 1197).*

International Search Report and Written Opinion for PCT/KR2022/015861, mailed Feb. 14, 2023, 11 pages.

* cited by examiner

AIR CONDITIONER AND CONTROL METHOD THEREOF

CROSS-REFERENCE TO RELATED APPLICATIONS

This application is a continuation of International Application No. PCT/KR2022/015861 designating the United States, filed on Oct. 18, 2022, in the Korean Intellectual Property Receiving Office and claiming priority to Korean Patent Application No. 10-2021-0176518, filed on Dec. 10, 2021, in the Korean Intellectual Property Office, the disclosures of each of which are incorporated by reference herein in their entireties.

BACKGROUND

Field

The disclosure relates to an air conditioner and a control method thereof, and for example, to an air conditioner controlling refrigerant circulation and a control method thereof.

Description of Related Art

In general, an air conditioner may include an indoor unit absorbing (or discharging) indoor heat and an outdoor unit discharging (or absorbing) heat to the outside. Specifically, the air conditioner may cool or heat air using a transfer of heat generated during evaporation and condensation of a refrigerant, and discharging the cooled or heated air, thereby managing the indoor air.

The air conditioner may draw in indoor air by rotating a fan disposed around an indoor heat exchanger while circulating a refrigerant. In addition, the air conditioner may heat-exchange the drawn-in air in the indoor heat exchanger, and discharge the heat-exchanged air to an indoor space.

The air conditioner may include a refrigerant circuit through which a refrigerant flows, and the refrigerant may exchange heat with indoor and outdoor air while circulating through the refrigerant circuit.

In addition, the air conditioner may include a compressor for rotating a refrigerant in the refrigerant circuit. The compressor may draw in low-temperature and low-pressure refrigerant gas and discharge high-temperature and high-pressure refrigerant gas. As such, the compressor is designed to compress the refrigerant gas, and thus inflow of a refrigerant liquid may cause the compressor to malfunction. In other words, in a case where the refrigerant liquid flows into the compressor, the durability and reliability of the compressor may be reduced.

SUMMARY

Embodiments of the disclosure may provide an air conditioner that may reduce, suppress, or prevent a refrigerant liquid from flowing into a compressor, and a control method thereof.

According to an example embodiment of the disclosure, an air conditioner may include: a compressor; a flow path switching valve; a first flow path connecting an outlet of the compressor to the flow path switching valve; a first heat exchanger; a second flow path connecting the first heat exchanger to the flow path switching valve; a first refrigerant port fluidly connected to an indoor unit; a third flow path extending from the first heat exchanger to the first refrigerant port; a sub-cooler provided on the third flow path; a first expansion valve provided between the first heat exchanger and the sub-cooler on the third flow path; a second expansion valve provided between the sub-cooler and the first refrigerant port on the third flow path; a fourth flow path branched from a branch point of the third flow path, passing through the sub-cooler, and extending to an inlet of the compressor; a third expansion valve provided between the sub-cooler and the branch point on the fourth flow path; a second refrigerant port fluidly connected to the indoor unit; a fifth flow path connecting the second refrigerant port to the flow path switching valve; a sixth flow path connecting the flow path switching valve to an intake port of the compressor; a pressure sensor provided on the fifth flow path; a first temperature sensor provided on the sixth flow path; and at least one processor, comprising processing circuitry, operatively connected to the compressor, the flow path switching valve, the first expansion valve, the second expansion valve, the third expansion valve, the pressure sensor, and the first temperature sensor. At least one processor, individually and/or collectively, may be configured to: control the flow path switching valve to connect the first flow path and the second flow path and connect the sixth flow path and the fifth flow path, based on an input for a cooling operation, and control at least one expansion valve of the first expansion valve or the second expansion valve based on an output of the pressure sensor and an output of the first temperature sensor.

According to an example embodiment of the disclosure, an air conditioner may include: a compressor; a flow path switching valve; a first flow path connecting an outlet of the compressor to the flow path switching valve; a first heat exchanger; a second flow path connecting the first heat exchanger to the flow path switching valve; a first refrigerant port fluidly connected to an indoor unit; a third flow path extending from the first heat exchanger to the first refrigerant port; a sub-cooler provided on the third flow path; a first expansion valve provided between the first heat exchanger and the sub-cooler on the third flow path; a second expansion valve provided between the sub-cooler and the first refrigerant port on the third flow path; a fourth flow path branched from a branch point of the third flow path, passing through the sub-cooler, and extending to an inlet of the compressor; a third expansion valve provided between the sub-cooler and the branch point on the fourth flow path; a second refrigerant port fluidly connected to the indoor unit; a fifth flow path connecting the second refrigerant port to the flow path switching valve; a sixth flow path connecting the flow path switching valve to an intake port of the compressor; a first temperature sensor provided on the sixth flow path; a fourth temperature sensor provided between the first expansion valve and the first heat exchanger on the third flow path; and at least one processor, comprising processing circuitry, operatively connected to the compressor, the flow path switching valve, the first expansion valve, the second expansion valve, the third expansion valve, the first temperature sensor, and the fourth temperature sensor. At least one processor, individually and/or collectively, may be configured to: control the flow path switching valve to connect the first flow path and the fifth flow path and connect the sixth flow path and the second flow path, based on an input for a heating operation, and control at least one expansion valve of the first expansion valve or the second expansion valve based on an output of the first temperature sensor and an output of the fourth temperature sensor.

According to an example embodiment of the disclosure, an air conditioner may include: a compressor; a flow path switching valve; a first flow path connecting an outlet of the compressor to the flow path switching valve; a first heat exchanger; a second flow connecting the first heat exchanger to the flow path switching valve; a first refrigerant port fluidly connected to an indoor unit; a third flow path extending from the first heat exchanger to the first refrigerant port; a sub-cooler provided on the third flow path; a first expansion valve provided between the first heat exchanger and the sub-cooler on the third flow path; a second expansion valve provided between the sub-cooler and the first refrigerant port on the third flow path; a fourth flow path branched from a branch point of the third flow path, passing through the sub-cooler, and extending to an inlet of the compressor; a third expansion valve provided between the sub-cooler and the branch point on the fourth flow path; a second refrigerant port fluidly connected to the indoor unit; a fifth flow path connecting the second refrigerant port to the flow path switching valve; a sixth flow path connecting the flow path switching valve to an intake port of the compressor; a discharge temperature sensor provided on the first flow path; and at least one processor, comprising processing circuitry, operatively connected to the compressor, the flow path switching valve, the first expansion valve, the second expansion valve, the third expansion valve, and the discharge temperature sensor. At least one processor, individually and/or collectively, may be configured to control at least one expansion valve of the first expansion valve or the second expansion valve based on an output of the discharge temperature sensor.

According to various example embodiments of the disclosure, an air conditioner and a control method thereof may reduce, suppress, or prevent a refrigerant liquid from flowing into a compressor. Thus, durability and reliability of the air conditioner may be improved.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
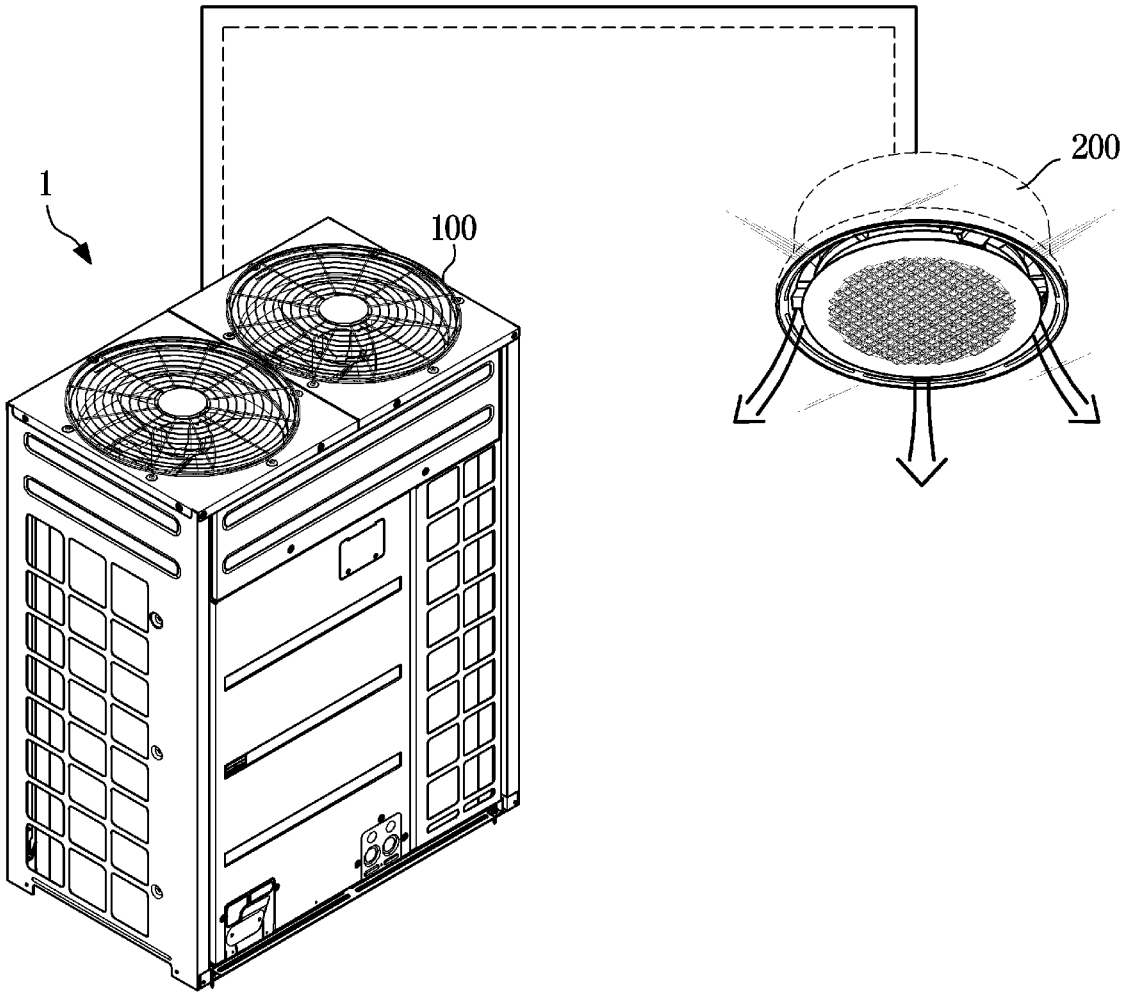
FIG. 1 is a diagram illustrating an example configuration of an air conditioner according to various embodiments.

Like reference numerals throughout the disclosure denote like elements. Also, this disclosure may not describe all the elements according to embodiments of the disclosure, and descriptions well-known in the art to which the disclosure pertains or overlapped portions may be omitted for brevity and clarity. The terms such as "~portion", "~block", "~member", "~module", and the like may be implemented in hardware or software or any combination thereof. According to embodiments, a plurality of "~portions", "~blocks", "~members", or "~modules" may be embodied as a single element, or a single "~portion", "~block", "~member", or "~module" may include a plurality of elements.

Throughout the disclosure, it will be understood that when an element is referred to as being "connected" to another element, it may be directly or indirectly connected to the other element, wherein the indirect connection includes "connection" via a wireless communication network.

It will be further understood that the term "include" when used in this disclosure, specifies the presence of stated elements, but do not preclude the presence or addition of one or more other elements.

It will also be understood that when one component is referred to as being "on" another component, it may be directly on the other component or another component may also be present.

Although the terms "first", "second", etc. may be used to describe different components, the terms do not limit the corresponding components, but are used simply for the purpose of distinguishing one component from another.

A singular form of a noun corresponding to an item may include one item or a plurality of the items unless context clearly indicates otherwise.

Reference numerals used for method steps are simply used for convenience of explanation, but not to limit an order of the steps. Thus, unless the context clearly dictates otherwise, the written order may be practiced otherwise.

Hereinafter, an operation principle and various example embodiments of the disclosure are described in greater detail with reference to the accompanying drawings.

Figure 2:
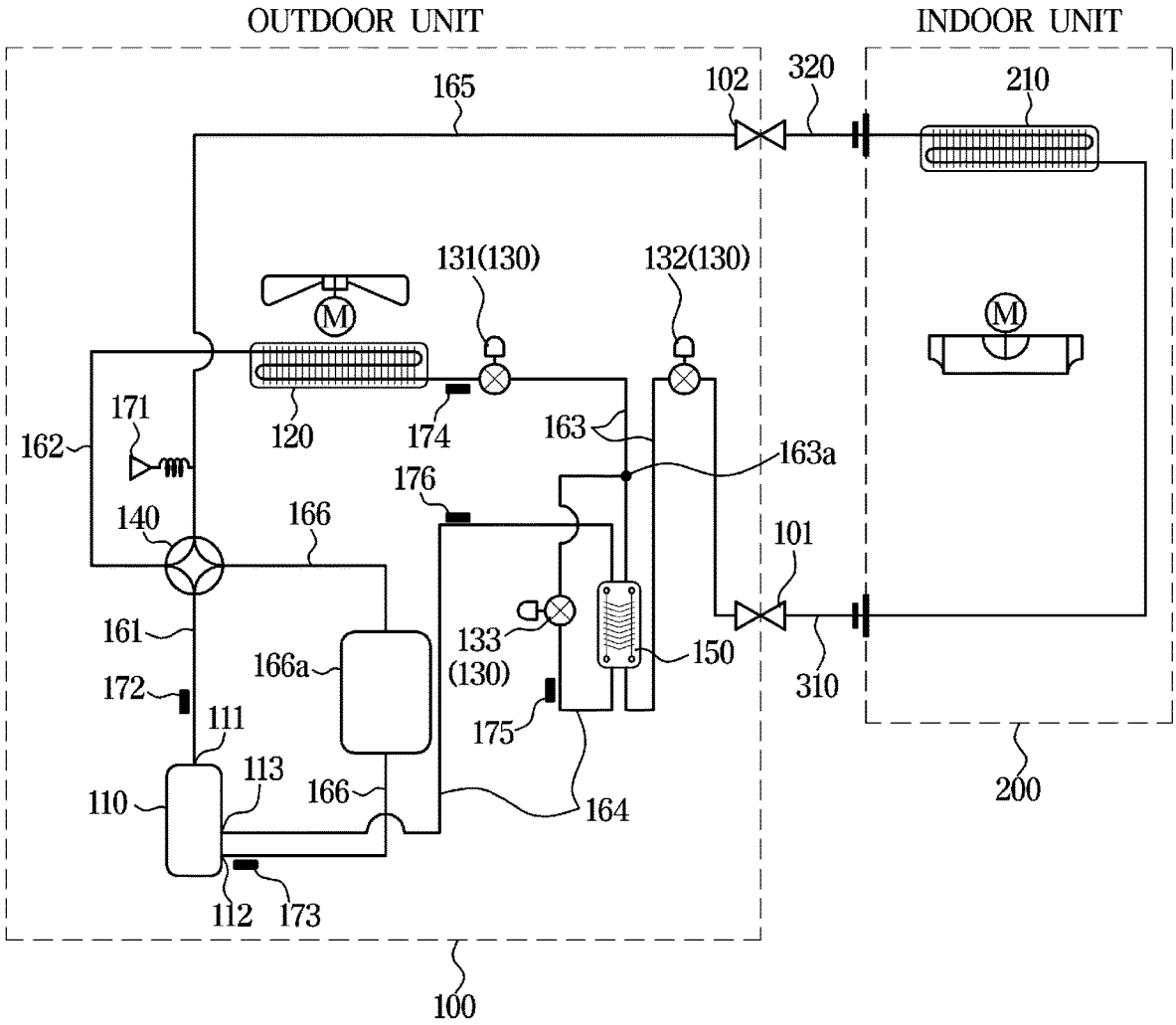
FIG. 2 is a diagram illustrating an example refrigerant circuit of an air conditioner according to various embodiments.

FIG. 1 is a diagram illustrating an example configuration of an air conditioner according to various embodiments. FIG. 2 is a diagram illustrating an example refrigerant circuit of an air conditioner according to various embodiments.

An air conditioner 1 may absorb heat from an inside of an air conditioning space, which is a target for air conditioning, and radiate the heat to an outside of the air conditioning space in order to cool the air conditioning space. In addition, the air conditioner 1 may absorb heat from the outside of the air conditioning space and radiate the heat into the air conditioning space in order to heat the air conditioning space. To this end, the air conditioner 1 may generally include an indoor unit installed in the air conditioning space and an outdoor unit installed outside the air conditioning space.

Referring to FIG. 1 and FIG. 2, the air conditioner 1 according to an embodiment may include one, or two or more outdoor units 100 (hereinafter referred to as "outdoor unit") installed outside the air conditioning space, and/or one, or two or more indoor units 200 (hereinafter referred to as "indoor unit") installed in the conditioning space. In addition to each of the indoor units 200, a plurality of remote controllers may be provided to control each of the indoor units 200. For example, a user may control a cooling or heating operation of the indoor unit using the remote controller.

The outdoor unit 100 may be fluidly connected to the indoor unit 200. For example, the outdoor unit 100 and the indoor unit 200 may form a refrigerant circuit for circulating a refrigerant.

The outdoor unit 100 may be electrically connected to the indoor unit 200. For example, a user may enter an input (or command) to control the indoor unit 200 through a user interface, and the outdoor unit 100 may operate in response to the user input of the indoor unit 200.

The outdoor unit 100 may be provided outside the air conditioning space (hereinafter referred to as "outdoors"), and in the outdoor unit 100, heat exchange may be performed between the refrigerant circulating through the refrigerant circuit and outdoor air. The outdoor unit 100 may perform heat exchange between the refrigerant and outdoor air using a phase change (e.g., evaporation or condensation) of the refrigerant. For example, while the refrigerant is condensed in the outdoor unit 100, heat of the refrigerant may be discharged to the outdoor air. In addition, while the refrigerant evaporates in the outdoor unit 100, the refrigerant may absorb the heat from the outdoor air.

Although a single outdoor unit 100 is shown in the drawings, the number of outdoor units 100 is not limited to the drawings. The air conditioner 1 may include a plurality of outdoor units.

The indoor unit 200 may be provided in the air conditioning space (hereinafter referred to as "indoors"), and in the indoor unit 200, heat exchange may be performed between the refrigerant circulating through the refrigerant circuit and indoor air. The indoor unit 200 may perform heat exchange between the refrigerant and indoor air using a phase change (e.g., evaporation or condensation) of the refrigerant. For example, while the refrigerant evaporates in the outdoor unit 100, the refrigerant may absorb heat from the indoor air, thereby cooling the air conditioning space. In addition, while the refrigerant is condensed in the indoor unit 200, heat of the refrigerant is discharged to the indoor air, thereby heating the air conditioning space.

Although a single indoor unit 200 is shown in the drawings, the number of indoor units 200 is not limited to the drawings. The air conditioner 1 may include a plurality of indoor units. For example, the indoor units 200 may be installed in a plurality of offices, a plurality of guest rooms, or a plurality of rooms in a building.

As such, the air conditioner 1 may perform heat exchange between the refrigerant and the outdoor air outside the air conditioning space, and perform heat exchange between the refrigerant and the indoor air inside the air conditioning space.

In this example, the air conditioner 1 may flow the refrigerant between the outside of the air conditioning space and the inside of the air conditioning space in order to transfer heat between the outside of the air conditioning space and the inside of the air conditioning space. In other words, the air conditioner 1 may include the refrigerant circuit for transferring heat between the outside of the air conditioning space and the inside of the air conditioning space.

For example, the air conditioner 1 may include the refrigerant circuit as illustrated and described in greater detail below with reference to FIG. 2.

Referring to FIG. 2, a refrigerant circuit may include a compressor 110, a first heat exchanger 120, an expansion valve 130, a second heat exchanger 210, and a plurality of flow paths connecting therewith. A refrigerant may circulate through the refrigerant circuit. For example, the refrigerant may circulate through the compressor 110, the first heat exchanger 120, the expansion valve 130, and the second heat exchanger 210 in order, or circulate through the compressor 110, the second heat exchanger 210, the expansion valve 130, and the first heat exchanger 120 in order.

The refrigerant circuit may further include a flow path switching valve 140, a sub-cooler 150, and an accumulator 166*a*. The flow path switching valve 140 may be connected to an outlet 111 of the compressor 110, and the accumulator 166*a* may be connected to an intake port 112 of the compressor 110. The sub-cooler 150 may be disposed between the first heat exchanger 120 and the second heat exchanger 210.

The compressor 110, the first heat exchanger 120, the expansion valve 130, the flow path switching valve 140, the accumulator 166*a*, and the sub-cooler 150 may be disposed in the outdoor unit 100. Also, the second heat exchanger 210 may be installed in the indoor unit 200. A position of the expansion valve 130 is not limited to the outdoor unit 100, and may be disposed in the indoor unit 200 as required.

As such, because some components of the refrigerant circuit may be provided in the outdoor unit 100 and the other components may be provided in the indoor unit 200, pipes 310 and 320 may be provided between the outdoor unit 100 and the indoor unit 200 to fluidly connect the outdoor unit 100 and the indoor unit 200. For example, the pipes 310 and 320 may include the liquid pipe 310 through which a refrigerant liquid flows and the gas pipe 320 through which refrigerant gas flows.

The outdoor unit 100 may include refrigerant ports 101 and 102 connected to the pipes 310 and 320, respectively. The outdoor unit 100 may include the first refrigerant port 101 connected to the liquid pipe 310 and the second refrigerant port 102 connected to the gas pipe 320. Each of the first refrigerant port 101 and the second refrigerant port 102 may include a bracket valve for distinguishing an inside of the outdoor unit 100 from an outside of the outdoor unit 100.

The outdoor unit 100 may further include flow paths arranged among the compressor 110, the flow path switching valve 140, the first heat exchanger 120, and the expansion valve 130.

For example, the outdoor unit 100 may include a first flow path 161 connecting the compressor 110 and the flow path switching valve 140, a second flow path 162 connecting the flow path switching valve 140 and the first heat exchanger 120, a third flow path 163 connecting the first heat exchanger 120 and the first refrigerant port 101 (indoor unit), a fourth flow path 164 branched from the third flow path 163 and extending to an inlet 113 of the compressor 110, a fifth flow path 165 connecting the second refrigerant port 102 (indoor unit) and the flow path switching valve 140, and a sixth flow path 166 connecting the flow path switching valve 140 and the intake port 112 of the compressor 110.

First and second expansion valves 131 and 132 and the sub-cooler 150 may be provided on the third flow path 163.

The sub-cooler 150 may be arranged between the first heat exchanger 120 and the first refrigerant port 101 on the third flow path 163.

The fourth flow path 164 may be branched off from the third flow path 163, pass through the sub-cooler 150, and extend to the inlet 113 of the compressor 110. A third expansion valve 133 may be disposed between a branch point 163*a* of the third flow path 163 and the sub-cooler 150.

The compressor 110 may draw in refrigerant gas from the sixth flow path 166 connected to the intake port 112, and may compress the refrigerant gas. The compressor 110 may discharge high-temperature and high-pressure refrigerant gas into the first flow path 161 connected to the outlet 111. For example, the compressor 110 may include a motor and a compression mechanism, and the compression mechanism may compress the refrigerant gas by a torque of the motor.

The compressor 110 may perform one-stage compression or two-stage compression. For example, a two-stage compressor may compress an introduced refrigerant gas (first-stage compression), and may compress the compressed refrigerant gas again (second-stage compression). The two-stage compressor may improve a compression efficiency of refrigerant using continuous compression.

The outlet 111 of the compressor 110 may be connected to the flow path switching valve 140 through the first flow path 161.

The flow path switching valve 140 may include, for example, a 4-way valve. The flow path switching valve 140 may switch a circulation path of the refrigerant depending on an operation mode (e.g., cooling operation or heating operation) of the air conditioner 1.

For example, the flow path switching valve 140 may operate in a first position during standby. The flow path switching valve 140 in the first position may close all of the first flow path 161, the second flow path 162, the third flow path 163, and the fourth flow path 164.

The air conditioner 1 may operate in a second position during cooling operation. The flow path switching valve 140 in the second position may connect the first flow path 161 to the second flow path 162, and connect the fifth flow path 165 to the sixth flow path 166. Accordingly, during the cooling operation of the air conditioner 1, the flow path switching valve 140 may guide the refrigerant gas discharged from the compressor 110 to the first heat exchanger 120, and the refrigerant may sequentially circulate through the compressor 110, the first heat exchanger 120, the expansion valve 130, and the second heat exchanger 210.

The air conditioner 1 may operate in a third position during heating operation. The flow path switching valve 140 in the third position may connect the first flow path 161 to the fifth flow path 165, and connect the second flow path 162 to the sixth flow path 166. Accordingly, during the heating operation of the air conditioner 1, the flow path switching valve 140 may guide the refrigerant gas discharged from the compressor 110 to the second heat exchanger 210, and the refrigerant may sequentially circulate through the compressor 110, the second heat exchanger 210, the expansion valve 130, and the first heat exchanger 120.

The flow path switching valve 140 may be connected to the first heat exchanger 120 through the second flow path 162.

In the first heat exchanger 120, heat exchange may occur between the refrigerant and outdoor air. For example, during the cooling operation, high-pressure and high-temperature refrigerant gas may be condensed in the first heat exchanger 120, and while the refrigerant is condensed, heat of the refrigerant may be discharged to the indoor air. The first heat exchanger 120 may discharge the refrigerant liquid. In addition, during the heating operation, low-temperature and low-pressure refrigerant liquid evaporates in the first heat exchanger 120, and while the refrigerant is evaporating, the refrigerant may absorb heat from indoor air. The first heat exchanger 120 may discharge the refrigerant gas.

An outdoor fan 160 may be provided near the first heat exchanger 120. The outdoor fan 160 may blow outdoor air to the first heat exchanger 120 to promote heat exchange between the refrigerant and the outdoor air.

The expansion valve 130 may include the plurality of expansion valves 131, 132, and 133. For example, the first expansion valve 131 may be disposed between the first heat exchanger 120 and the sub-cooler 150, the second expansion valve 132 may be disposed between the sub-cooler 150 and the first refrigerant port 101, and the third expansion valve 133 may be disposed between the branch point 163*a* and the sub-cooler 150.

The expansion valves 131, 132, and 133 may lower a temperature and pressure of the refrigerant liquid using a throttling effect. For example, the expansion valves 131, 132, and 133 may include an orifice that may reduce a cross-sectional area of flow path. The temperature and pressure of the refrigerant liquid that has passed through the orifice may be reduced.

As described above, the expansion valves 131, 132, and 133 may expand the high-temperature and high-pressure refrigerant liquid and discharge the low-temperature and low-pressure refrigerant liquid. For example, the expansion valves 131, 132, and 133 may lower the pressure and temperature of the refrigerant liquid condensed in the first heat exchanger 120 during the cooling operation, and may lower the pressure and temperature of the refrigerant liquid condensed in the second heat exchanger 210 during the heating operation.

Due to the decrease in pressure of the refrigerant liquid passing through the expansion valves 131, 132, and 133, an evaporation point (saturation temperature) of the refrigerant liquid passing through the expansion valves 131, 132, and 133 may be lowered. In this instance, in response to the evaporation point of the refrigerant liquid reaching a temperature of the refrigerant liquid due to decompression, some of the refrigerant liquid may evaporate and phase-converted into refrigerant gas. In this case, the temperature of the refrigerant liquid may be approximately equal to the evaporation point of the refrigerant liquid.

The expansion valves 131, 132, and 133 may be implemented as solenoid valves that may adjust an opening ratio (a ratio of a flow path's cross-sectional area of a valve in a partially open state to a flow path's cross-sectional area of a valve in a fully open state). Depending on the opening ratio of the expansion valves 131, 132 and 133, the amount of refrigerant passing through the refrigerant circuit may be controlled.

For example, as the opening ratio of the first and second expansion valves 131 and 132 increases, the amount of refrigerant passing through the compressor 110, the first heat exchanger 120, and the second heat exchanger 210 may increase. As the opening ratio of the first and second expansion valves 131 and 132 decreases, the amount of refrigerant passing through the compressor 110, the first heat exchanger 120, and the second heat exchanger 210 may decrease.

In addition, as the opening ratio of the third expansion valve 133 increases, the amount of refrigerant gas injected into the compressor 110 may increase. As the opening ratio of the third expansion valve 133 decreases, the amount of refrigerant gas injected into the compressor 110 may decrease.

As such, the expansion valves 131, 132 and 133 may not only reduce the pressure of the refrigerant liquid, but also adjust or control the amount of refrigerant circulating through the refrigerant circuit.

The sub-cooler 150 may be arranged between the first expansion valve 131 and the second expansion valve 132.

The third flow path 163 and the fourth flow path 164 may pass through the sub-cooler 150. The third flow path 163 extending from the first heat exchanger 120 to the first refrigerant port 101 may pass through the sub-cooler 150, and the fourth flow path 164 extending from the first heat exchanger 120 to the compressor 110 may also pass through the sub-cooler 150.

The third expansion valve 133 may be arranged between the branch point 163*a* of the fourth flow path 164 and the sub-cooler 150, and a pressure and temperature of the refrigerant liquid may be reduced while passing through the third expansion valve 133. In particular, an evaporation point of the refrigerant liquid decompressed in the third expansion valve 133 may be lowered, leading to easy evaporation.

By passing through the third expansion valve 133, a pressure and temperature of the refrigerant liquid passing through the fourth flow path 164 may be lower than those of the refrigerant liquid passing through the third flow path 163. As a result, the refrigerant passing through the fourth flow path 164 may absorb heat from the refrigerant passing through the third flow path 163, and may evaporate. In addition, the refrigerant passing through the third flow path 163 may supply heat to the refrigerant passing through the fourth flow path 164, and may be cooled.

As such, the refrigerant liquid circulating through the refrigerant circuit (refrigerant liquid passing through the third flow path) may be cooled while passing through the sub-cooler 150, and thus a cooling efficiency of the refrigerant circuit may be improved.

In addition, the refrigerant passing through the fourth flow path 164 may be evaporated in the sub-cooler 150, and the refrigerant gas may be injected through the inlet 113 of the compressor 110.

The refrigerant gas injected into the compressor 110 may reduce a temperature of the high-temperature and high-pressure refrigerant gas discharged from the compressor 110. For example, in a case where the air conditioner 1 includes a one-stage compressor, the refrigerant gas evaporated in the sub-cooler 150 may be injected into the compression mechanism of the compressor, and a temperature of the compressed refrigerant may be lowered. In another example, in a case where the air conditioner 1 includes a two-stage compressor, the refrigerant gas evaporated in the sub-cooler 150 may be injected between a first-stage compression mechanism and a second-stage compression mechanism, and a temperature of the compressed refrigerant may be lowered.

As described above, by injecting the refrigerant gas into the compressor 110, the temperature of the refrigerant gas discharged from the compressor 110 may be lowered, and overheating of the compressor 110 may be suppressed or prevented.

The second heat exchanger 210 may be disposed in the indoor unit 200, and in the second heat exchanger 210, heat exchange may occur between the refrigerant and indoor air.

For example, during the cooling operation, low-pressure and low-temperature refrigerant liquid may be evaporated in the second heat exchanger 210, and while the refrigerant liquid is evaporating, the refrigerant may absorb heat from indoor air. As a result, the air conditioning space may be cooled. During the cooling operation, the second heat exchanger 210 may discharge refrigerant gas.

In addition, during the heating operation, high-temperature and high-pressure refrigerant gas may be condensed in the second heat exchanger 210, and while the refrigerant gas is condensed, the refrigerant may discharge heat to the indoor air. As a result, the air conditioning space may be heated. During the heating operation, the second heat exchanger 210 may discharge the refrigerant liquid.

An indoor fan 220 may be provided near each second heat exchanger 210. The indoor fan 220 may blow indoor air to the second heat exchanger 210 to promote heat exchange between the refrigerant and outdoor air.

The accumulator 166*a* may be arranged on the sixth flow path 166 on the intake port 112 side of the compressor 110.

The accumulator 166*a* may be supplied with low-temperature and low-pressure refrigerant gas evaporated in the second heat exchanger 210 or the first heat exchanger 120. For example, during the cooling operation, the accumulator 166*a* may be supplied with the low-temperature and low-pressure refrigerant gas evaporated in the second heat exchanger 210. During the heating operation, the accumulator 166*a* may be supplied with the low-temperature and low-pressure refrigerant gas evaporated in the second heat exchanger 210.

Depending on a load, the refrigerant may be incompletely evaporated in the second heat exchanger 210 or the first heat exchanger 120, and a refrigerant having a mixture of refrigerant liquid and refrigerant gas may be introduced into the accumulator 166*a*. The accumulator 166*a* may separate the refrigerant liquid from the refrigerant gas, and provide the refrigerant gas from which the refrigerant liquid has been separated to the compressor 110.

The refrigerant circuit may be provided with a plurality of sensors to monitor an operation of the refrigerant circuit.

A pressure sensor 171 may be provided on the fifth flow path 165 between the flow path switching valve 140 and the second refrigerant port 102 to measure a pressure of the refrigerant gas passing through the fifth flow path 165. During the cooling operation of the air conditioner 1, the pressure sensor 171 may measure a pressure of the low-temperature and low-pressure refrigerant gas evaporated in the second heat exchanger 210. In addition, during the heating operation of the air conditioner 1, the pressure sensor 171 may measure a pressure of the high-temperature and high-pressure refrigerant gas compressed in the compressor 110.

A discharge temperature sensor 172 may be provided at the outlet 111 side of the compressor 110 to measure a temperature of the high-temperature and high-pressure refrigerant gas discharged from the compressor 110. Specifically, the discharge temperature sensor 172 may be arranged on the first flow path 161 connecting the compressor 110 and the flow path switching valve 140.

An intake temperature sensor 173 may be provided at the inlet side of the compressor 110 to measure a temperature of the low-temperature and low-pressure refrigerant gas drawn into the compressor 110. The intake temperature sensor 173 may be arranged on the sixth flow path 166 connecting the accumulator 166*a* and the flow path switching valve 140. The intake temperature sensor 173 may measure the temperature of the refrigerant that passes through the accumulator 166*a* and is drawn into the compressor 110.

A liquid temperature sensor 174 may be provided on the third flow path 163 connecting the first heat exchanger 120 and the first refrigerant port 101 to measure a temperature of the refrigerant liquid passing through the third flow path 163. Specifically, the liquid temperature sensor 174 may be arranged between the first heat exchanger 120 and the first expansion valve 131. During the cooling operation of the air conditioner 1, the liquid temperature sensor 174 may measure the temperature of the refrigerant liquid condensed by the first heat exchanger 120. In addition, during the heating operation of the air conditioner 1, the liquid temperature sensor 174 may measure the temperature of the refrigerant liquid expanded by the first expansion valve 131.

A branch temperature sensor 175 may be provided on an inlet side of the sub-cooler 150 on the fourth flow path 164 to measure a temperature of the refrigerant liquid flowing into the sub-cooler 150 through the fourth flow path 164. Because the refrigerant liquid flowing into the sub-cooler 150 through the fourth flow path 164 may be decompressed and cooled in the third expansion valve 133, the temperature detected by the branch temperature sensor 175 may be equal to or lower than an evaporation point of the decompressed refrigerant liquid.

An injection temperature sensor 176 may be provided on an outlet side of the sub-cooler 150 on the fourth flow path 164 to measure a temperature of the refrigerant gas discharged from the sub-cooler 150 to the fourth flow path 164. Because the refrigerant gas discharged from the sub-cooler 150 to the fourth flow path 164 may be evaporated in the sub-cooler 150, the temperature detected by the injection temperature sensor 176 may be equal to or higher than an evaporation point of the decompressed refrigerant liquid.

As such, the outdoor unit 100 may be provided with the pressure sensor 171, the discharge temperature sensor 172, the intake temperature sensor 173, the liquid temperature sensor 174, the branch temperature sensor 175, and the injection temperature sensor 176.

However, the sensors installed in the outdoor unit 100 to monitor a state of the refrigerant circuit are not limited to those shown in FIG. 2. For example, the sensors installed in the outdoor unit 100 may further include an additional temperature sensor or an additional pressure sensor in addition to the sensors shown in FIG. 2. In addition, some of the sensors shown in FIG. 2 may be omitted.

As described above, the air conditioner 1 may include the refrigerant circuit for heating or cooling the air conditioning space. Also, the air conditioner 1 may be provided with a plurality of sensors (e.g., pressure sensor and/or temperature sensor) for monitoring the state of the refrigerant flowing in the refrigerant circuit.

Figure 3:
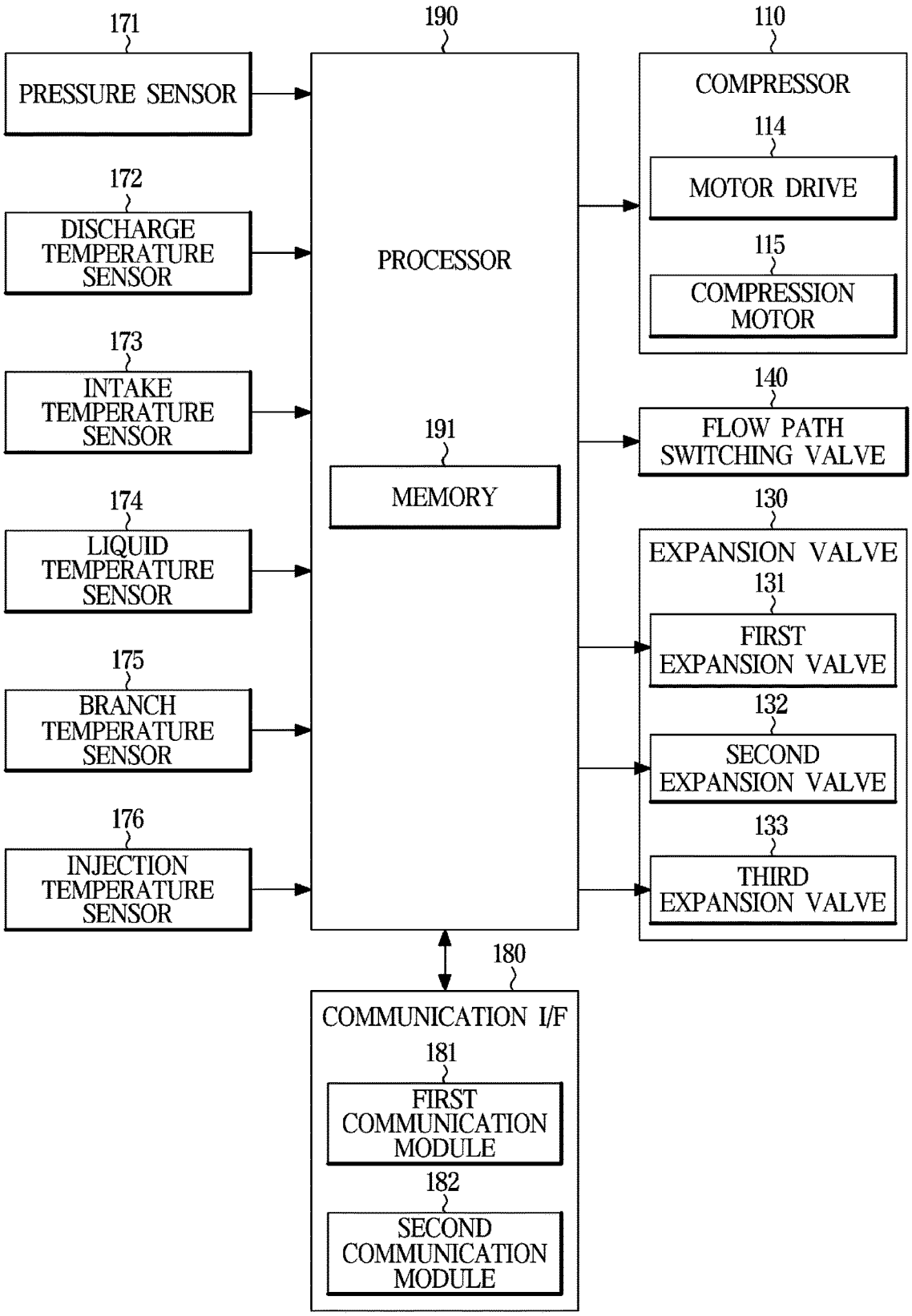
FIG. 3 is a block diagram illustrating an example configuration of an outdoor unit included in an air conditioner according to various embodiments.

FIG. 3 is a block diagram illustrating an example configuration of an outdoor unit included in an air conditioner according to various embodiments.

Referring to FIG. 3, the outdoor unit 100 may include the pressure sensor 171, the discharge temperature sensor 172, the intake temperature sensor 173, the liquid temperature sensor 174, the branch temperature sensor 175, the injection temperature sensor 176, the compressor 110, the flow path switching valve 140, the expansion valve 130 (e.g., including first, second and third expansion valves 131, 132, 133, respectively), a communication interface 180, and/or a processor (e.g., including processing circuitry) 190.

The pressure sensor 171 may measure a pressure of refrigerant gas discharged from the compressor 110 during a cooling operation, and measure a pressure of refrigerant gas drawn into the compressor 110 during a heating operation. The pressure sensor 171 may provide the processor 190 with an electrical signal (e.g., a voltage signal or a current signal) corresponding to the measured pressure (discharge pressure signal).

The discharge temperature sensor 172 may measure a temperature of the refrigerant gas discharged from the compressor 110 and provide the processor 190 with an electrical signal (discharge temperature signal) corresponding to the measured discharge temperature.

The intake temperature sensor 173 may measure a temperature of the refrigerant gas drawn into the compressor 110 and provide the processor 190 with an electrical signal (intake temperature signal) corresponding to the measured intake temperature.

The liquid temperature sensor 174 may measure a temperature of a refrigerant liquid discharged from the first heat exchanger 120 during the cooling operation, and may measure a temperature of a refrigerant liquid discharged from the first expansion valve 131 during the heating operation. The liquid temperature sensor 174 may provide the processor 190 with an electrical signal (liquid temperature signal) corresponding to the measured temperature.

The branch temperature sensor 175 may measure a temperature of the refrigerant liquid flowing into the sub-cooler 150 from the fourth flow path 164, and may provide the processor 190 with an electrical signal (branch temperature signal) corresponding to the measured temperature.

The injection temperature sensor 176 may measure a temperature of the refrigerant gas discharged from the sub-cooler 150 to the fourth flow path 164, and provide the processor 190 with an electrical signal (injection temperature signal) corresponding to the measured temperature.

The compressor 110 may be provided on a refrigerant circuit and may compress a low-temperature and low-pressure refrigerant gas to discharge a high-temperature and high-pressure refrigerant gas.

The compressor 110 may include a compression motor 115 and a motor drive 114. The compressor 110 may further include a compression mechanism.

The compression motor 115 may be connected to the compression mechanism through a rotation shaft, and may provide rotational force (torque) to the compression mechanism.

The compression motor 115 may include a stator coupled to a housing of the compressor 110, and a rotor provided to be rotatable with respect to the stator. The rotor may be connected to the rotation shaft connected to the compression mechanism. The rotor may rotate through magnetic interaction with the stator, and the rotation of the rotor may be transferred to the compression mechanism through the rotation shaft.

The compression motor 115 may include, for example, a Brushless Direct Current (BLDC) motor or a Permanent Magnet Synchronous Motor (PMSM) that allows for easy control of a rotation speed.

The motor drive 114 may receive a driving signal for operating the compressor 110 from the processor 190, and based on a driving signal of the processor 190, may control a driving current supplied to the compression motor 115 for rotating the rotation shaft of the compression motor 115. For example, the motor drive 114 may receive a driving signal including a speed command of the compression motor 115, and may control a driving current supplied to the compression motor 115 to allow a rotation speed of the compression motor 115 to follow the speed command.

For example, in a case where the compression motor 115 is a BLDC motor, the motor drive 114 may supply pulse width-modulated direct current to the compression motor 115. In addition, in a case where the compression motor 115 is a PMSM, the motor drive 114 may supply alternating current to the compression motor 115 using vector control.

The compression mechanism may compress the refrigerant gas using a torque provided from the compression motor 115. For example, the compression mechanism may convert the torque into translational motion of a piston and use the translational motion of the piston to compress the refrigerant gas. In addition, the compression mechanism may rotate a roller (or rolling piston) using a torque and may compress the refrigerant gas using a rotational motion of the roller.

The flow path switching valve 140 may switch a circulation path of the refrigerant depending on an operation mode (cooling operation or heating operation) of the air conditioner 1.

The flow path switching valve 140 may switch the circulation path of the refrigerant in response to a mode switching signal of the processor 190. For example, in response to a cooling mode signal of the processor 190, the flow path switching valve 140 may connect the outlet 111 of the compressor 110 to the first heat exchanger 120 and connect the intake port 112 of the compressor 110 to the second heat exchanger 210. In addition, in response to a heating mode signal of the processor 190, the flow path switching valve 140 may connect the outlet 111 of the compressor 110 to the second heat exchanger 210, and connect the intake port 112 of the compressor 110 to the first heat exchanger 120.

As described above, the expansion valve 130 may expand a high-temperature and high-pressure refrigerant liquid to discharge a low-temperature and low-pressure refrigerant liquid. The expansion valve 130 may include an orifice that reduces a cross-sectional area of a flow path in response to a control signal of the processor 190. The refrigerant liquid passing through the orifice may expand, thereby reducing a temperature and pressure of the refrigerant liquid.

The expansion valve 130 may adjust the amount of refrigerant circulating through the refrigerant circuit in response to a control signal of the processor 190. For example, the first and second expansion valves 131 and 132 may control the amount of refrigerant passing through the compressor 110, the first heat exchanger 120, and the second heat exchanger 210. The third expansion valve 133 may control the amount of refrigerant that passes through the sub-cooler 150 and is injected into the compressor 110.

The communication interface 180 may include a first communication module 181 including various communication circuitry for transmitting and receiving communication signals with the indoor unit 200 and/or a control panel 300, and a second communication module 182 including various communication circuitry for transmitting and receiving communication signals with an external device (e.g., a user device, etc.) of the air conditioner 1.

The first communication module 181 may transmit and receive communication signals to and from the indoor unit 200 and/or the control panel 300 through a communication line. For example, the first communication module 181 may receive transmission data from the processor 190, and may convert (or modulate) digital transmission data into an analog transmission signal. The first communication module 181 may transmit a transmission signal through a communication line. In addition, the first communication module 181 may receive a reception signal through a communication line, and may convert (or modulate) an analog reception signal into digital reception data. The first communication module 181 may provide the processor 190 with the reception data.

For example, the first communication module 181 may transmit and receive communication signals to and from the indoor unit 200 and/or the control panel 300 using an asynchronous serial communication method.

The second communication module 182 may transmit and receive communication signals to and from an external device (e.g., a user device of an administrator) through a wired communication network (or a wireless communication network). The wired communication network may include a communication network, such as a cable network or a telephone network, and the wireless communication network may include a communication network that transmits and receives signals through radio waves. The wired communication network and the wireless communication network may be connected to each other. For example, the wired communication network may include a Wide Area Network (WAN), such as the Internet, and the wireless communication network may include an Access Point (AP) connected to the WAN.

The second communication module 182 may connect to a wired communication network through, for example, Ethernet (Ethernet, IEEE 802.3 technology standard), and communicate with external devices through the wired communication network.

The processor 190 may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions. The processor 190 may, for example, be electrically connected to the pressure sensor 171, the discharge temperature sensor 172, the intake temperature sensor 173, the liquid temperature sensor 174, the branch temperature sensor 175, the injection temperature sensor 176, the compressor 110, the flow path switching valve 140, the expansion valve 130, and the communication interface 180.

The processor 190 may include a memory 191 in which a program (a plurality of instructions) or data for processing signals and providing control signals is stored or memorized.

The memory 191 may include volatile memories, such as a Static Random Access Memory (S-RAM), a Dynamic Random Access Memory (D-RAM) and non-volatile memories, such as a Read Only Memory (ROM), an Erasable Programmable Read Only Memory (EPROM), and the like. The memory 191 may be provided integrally with the processor 190 or as a separate semiconductor device separated from the processor 190.

The processor 190 may further include a processing core (e.g., an arithmetic circuit, a memory circuit, and a control circuit) that processes a signal based on the program or data stored in the memory 191 and outputs a control signal.

The processor 190 may provide a control signal to the compressor 110, the flow path switching valve 140, and/or the expansion valve 130 to provide the refrigerant for heat exchange to the indoor unit 200. For example, the processor 190 may receive a user input from the indoor unit 200, and may provide the control signal to the compressor 110, the flow path switching valve 140, and/or the expansion valve 130 to circulate the refrigerant in response to the user input.

For example, in response to an input (e.g., a user input) for cooling operation, the processor 190 may control the flow path switching valve 140 to connect the outlet 111 of the compressor 110 to the first heat exchanger 120, and may control the motor drive 114 to supply a driving current to the compression motor 115 of the compressor 110.

In addition, in response to a user input for heating operation, the processor 190 may control the flow path switching valve 140 to connect the outlet 111 of the compressor 110 to the second heat exchanger 210, and may control the motor drive 114 to supply a driving current to the compression motor 115 of the compressor 110.

The processor 190 may collect information about a state of the refrigerant circuit for stable operation of the compressor 110, and control an operation of the refrigerant circuit based on the collected information.

For example, in order to control the refrigerant gas drawn into the compressor 110, the processor 190 may collect a pressure and temperature of the refrigerant gas drawn into the compressor 110. The processor 190 may control the first expansion valve 131 or the second expansion valve 132 to adjust an opening ratio of the first expansion valve 131 or the second expansion valve 132 based on the pressure and temperature of the refrigerant drawn into the compressor 110.

In addition, in order to control the refrigerant gas injected into the compressor 110, the processor 190 may collect a branch temperature of the refrigerant flowing into the sub-cooler 150 and an injection temperature of the refrigerant discharged from the sub-cooler 150. The processor 190 may control the third expansion valve 133 to adjust an opening ratio of the third expansion valve 133 based on the branch temperature and the injection temperature.

As described above, the outdoor unit 100 may provide the indoor unit 200 with a refrigerant for heat exchange for air conditioning in the indoor space. Also, for stable operation of the compressor 110, the outdoor unit 100 may collect information about the state of the refrigerant circuit, and may adjust or control the amount of refrigerant circulating through the refrigerant circuit based on the collected information.

Figure 4:
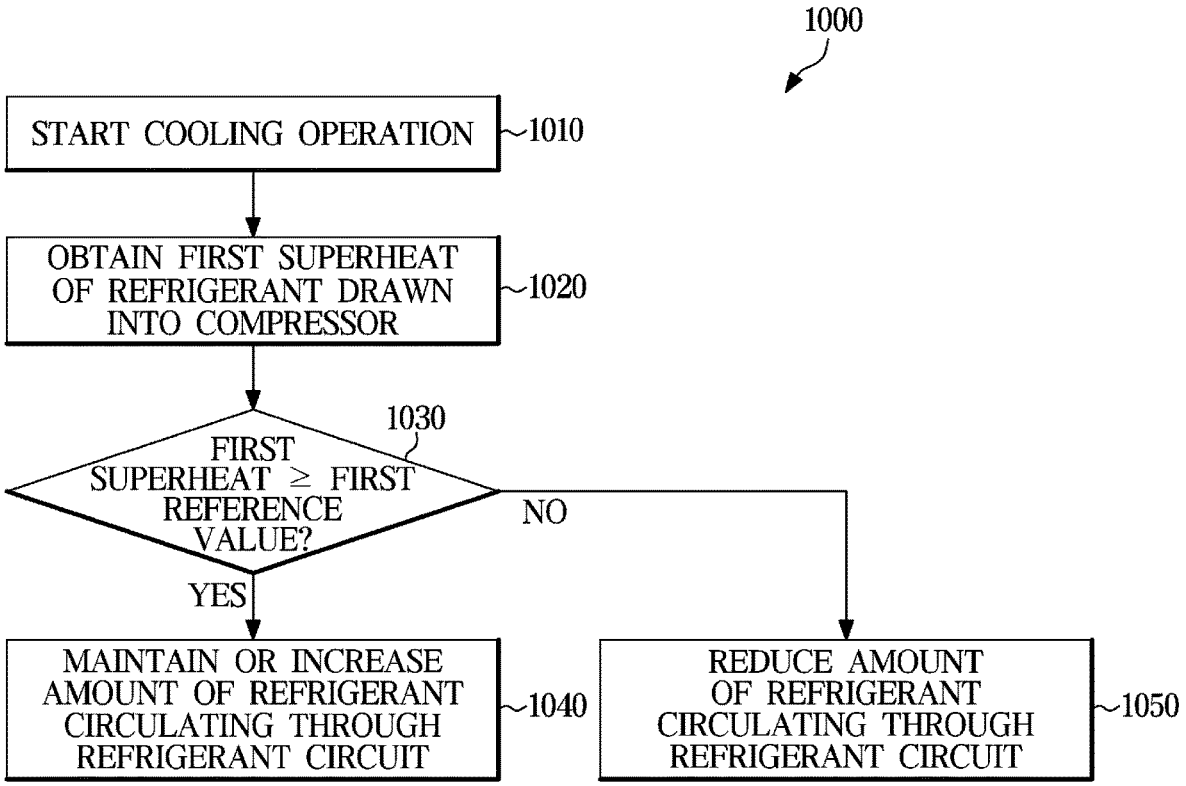
FIG. 4 is a flowchart illustrating an example method of controlling the amount of refrigerant circulating through a refrigerant circuit during a cooling operation of an air conditioner according to various embodiments.
Figure 5:
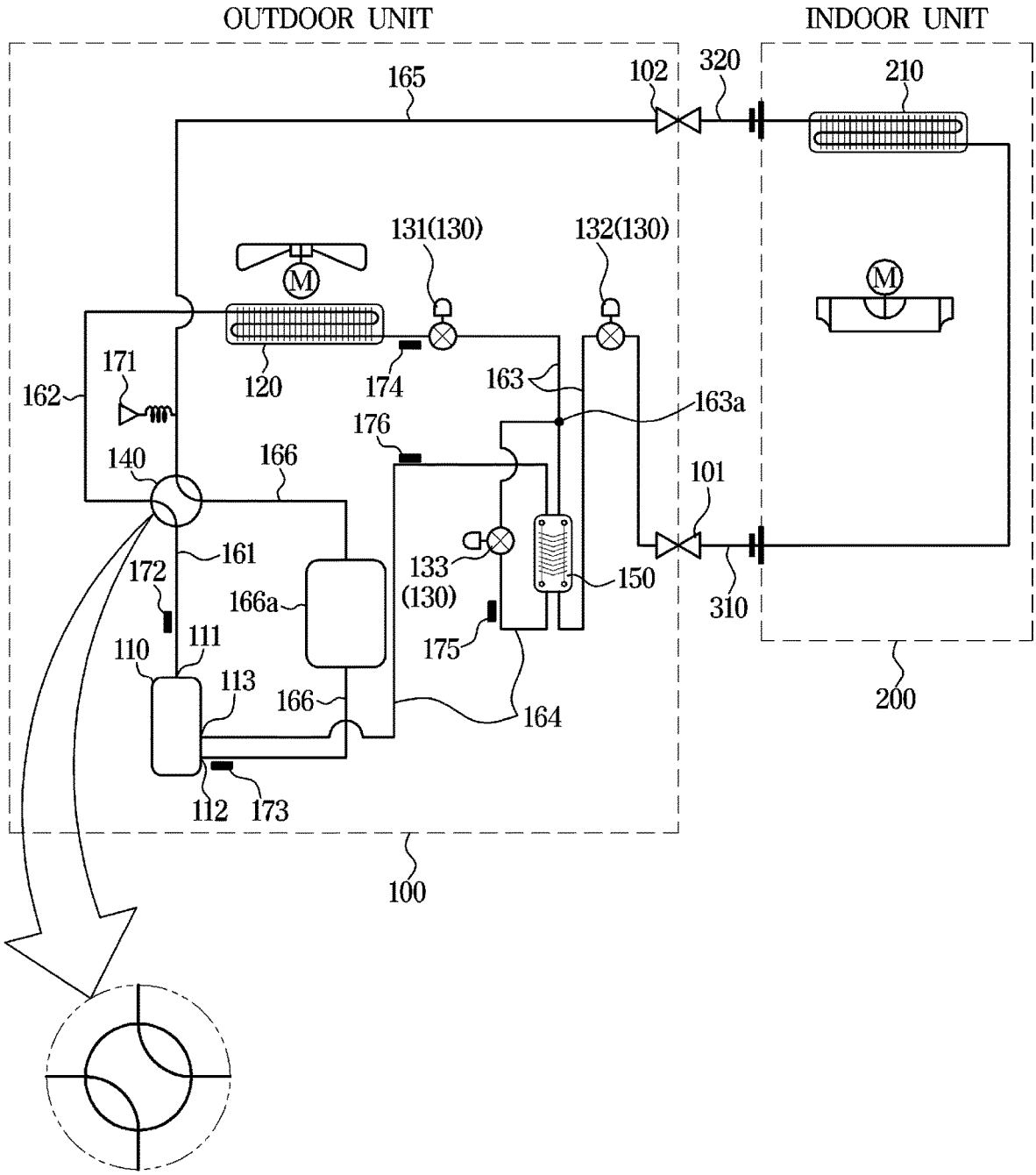
FIG. 5 is a diagram illustrating an example refrigerant circuit during a cooling operation of an air conditioner according to various embodiments.

FIG. 4 is a flowchart illustrating an example method of controlling the amount of refrigerant circulating through a refrigerant circuit during a cooling operation of an air conditioner according to various embodiments. FIG. 5 is a diagram illustrating an example refrigerant circuit during a cooling operation of an air conditioner according to various embodiments.

With reference to FIG. 4 and FIG. 5, a method of controlling the amount of refrigerant circulating through a refrigerant circuit during a cooling operation is described in greater detail.

The air conditioner 1 may start a cooling operation (1010).

The air conditioner 1 may obtain a user input through a user interface provided in the indoor unit 200. For example, the air conditioner 1 may start the cooling operation when a user selects the cooling operation or selects a target temperature lower than a room temperature.

For cooling operation, the processor 190 of the outdoor unit 100 may switch a position of the flow path switching valve 140. The processor 190 may switch the position of the flow path switching valve 140 to a second position to connect the first flow path 161 to the second flow path 162 and connect the sixth flow path 166 to the fifth flow path 165, as shown in FIG. 5.

In addition, the processor 190 may control the motor drive 114 to supply a driving current to the compression motor 115 of the compressor 110 for cooling operation.

As shown in FIG. 5, a refrigerant gas compressed by the compressor 110 may flow into the first heat exchanger 120 through the flow path switching valve 140 in the second position. The refrigerant gas may be condensed in the first heat exchanger 120, and a refrigerant liquid may be discharged from the first heat exchanger 120.

The refrigerant liquid discharged from the first heat exchanger 120 may pass through the sub-cooler 150 and be decompressed in the second expansion valve 132. The refrigerant liquid may be guided to the second heat exchanger 210 of the indoor unit 200 through the liquid pipe 310.

The refrigerant liquid may be evaporated in the second heat exchanger 210, and the refrigerant gas evaporated in the second heat exchanger 210 may be guided to the outdoor unit 100 through the gas pipe 320. The refrigerant gas may be drawn into the compressor 110 through the flow path switching valve 140 in the second position.

The air conditioner 1 may obtain a first superheat (intake superheat) of the refrigerant gas drawn into the compressor 110 during the cooling operation (1020).

The superheat of the refrigerant gas may represent a difference between an actual temperature of the refrigerant gas and a saturation temperature of the refrigerant gas. Specifically, the superheat may be obtained by [Equation 1] below.

$$SH = T_m - T_s \qquad \text{[Equation 1]}$$

Here, SH may denote the superheat of the refrigerant gas, $T_m$ may denote the actual temperature of the refrigerant gas, and $T_s$ may denote the saturation temperature of the refrigerant gas.

The actual temperature of the refrigerant gas drawn into the compressor 110 through the sixth flow path 166 may be measured by the intake temperature sensor 173. The intake temperature sensor 173 may be provided on the sixth flow path 166 connected to the intake port 112 of the compressor 110 to measure a temperature (hereinafter referred to as "intake temperature") of the refrigerant gas drawn into the compressor 110. The intake temperature sensor 173 may provide the processor 190 with an electrical signal corresponding to the intake temperature, and the processor 190 may identify the intake temperature based on an output signal of the intake temperature sensor 173.

The saturation temperature of the refrigerant gas drawn into the compressor 110 through the sixth flow path 166 may be calculated based on an output signal of the pressure sensor 171. The pressure sensor 171 may be arranged on the fifth flow path 165 between the flow path switching valve 140 and the second refrigerant port 102 to measure a pressure (hereinafter referred to as "pressure of the fifth flow path") of the refrigerant gas passing through the fifth flow path 165. Also, because the sixth flow path 166 is connected to the fifth flow path 165 by the flow path switching valve 140 in the second position, the pressure measured by the pressure sensor 171 may be approximately equal to the pressure (hereinafter referred to as "intake pressure") of the refrigerant gas drawn into the compressor 110 through the sixth flow path 166. The pressure sensor 171 may provide the processor 190 with an electrical signal corresponding to the intake pressure, and the processor 190 may identify the intake pressure.

In addition, in the memory 191, a table including a plurality of pressure values of refrigerant gas and a plurality of saturation temperatures respectively corresponding to the plurality of pressure values of the refrigerant gas may be stored in advance. The processor 190 may identify a saturation temperature corresponding to an intake pressure with reference to the table stored in the memory 191. In other words, the processor 190 may identify the saturation temperature of the refrigerant gas drawn into the compressor 110.

The processor 190 may identify the first superheat of the refrigerant gas based on a difference between the saturation temperature and the intake temperature of the refrigerant gas drawn into the compressor 110.

The air conditioner 1 may identify whether the first superheat is greater than or equal to a first reference value during the cooling operation (1030).

The superheat of the refrigerant gas drawn into the compressor 110 may indicate the difference between the actual temperature of the refrigerant gas drawn into the compressor 110 and the saturation temperature (corresponding to the intake pressure) of the refrigerant gas (intake temperature).

In this instance, because the refrigerant gas is condensed at a temperature lower than the saturation temperature, the superheat of the refrigerant gas may be a positive number greater than "0".

For example, in response to the superheat of the refrigerant gas being "0", the refrigerant drawn into the compressor 110 may include not only the refrigerant gas but also the refrigerant liquid. In other words, the refrigerant liquid may be drawn into the compressor 110.

In addition, in response to the superheat of the refrigerant gas being significantly greater than "0", the refrigerant drawn into the compressor 110 may include only the refrigerant gas, but an effect of preventing and/or reducing overheating of the compressor 110 may be reduced. In other words, a cooling performance or cooling efficiency of the air conditioner 1 may be reduced.

The compressor 110 may be designed to compress the refrigerant gas, and in a case where the refrigerant liquid is drawn into the compressor 110, the compressor 110 may malfunction.

In order to suppress or prevent the refrigerant liquid from being drawn into the compressor 110, the air conditioner 1 may control the refrigerant circuit to maintain the first superheat of the refrigerant gas drawn into the compressor 110 at a positive number close to "0".

For example, the processor 190 may compare the first superheat of the refrigerant gas drawn into the compressor 110 with the first reference value, and may identify whether the first superheat is greater than or equal to the first reference value. Here, the first reference value may be a positive number close to "0", for example, a value between 1 and 4.

In response to the first superheat being greater than or equal to the first reference value (Yes in operation 1030), the air conditioner 1 may maintain or increase the amount of refrigerant circulating through the refrigerant circuit (1040).

The first superheat greater than or equal to the first reference value during the cooling operation may indicate that the refrigerant gas is further heated by the air in an air conditioning space after the refrigerant liquid is evaporated in the second heat exchanger 210 provided in the air conditioning space. In other words, the first superheat greater than or equal to the first reference value during the cooling operation may indicate that the amount of refrigerant passing through the second heat exchanger 210 may be insufficient. Accordingly, the air conditioner 1 may increase the amount of refrigerant passing through the second heat exchanger 210 to increase the heat absorbed while the refrigerant liquid evaporates in the second heat exchanger 210.

The first expansion valve 131 and/or the second expansion valve 132 may adjust or control the amount of refrigerant circulating through the refrigerant circuit. For example, the processor 190 may control the first expansion valve 131 and/or the second expansion valve 132 to increase the amount of refrigerant circulating through the refrigerant circuit. The processor 190 may increase an opening ratio of the first expansion valve 131 and/or the second expansion valve 132, or maintain the opening ratio at a maximum opening ratio.

In response to the first superheat being less than the first reference value (No in operation 1030), the air conditioner 1 may reduce the amount of refrigerant circulating through the refrigerant circuit (1050).

The first superheat less than the first reference value during the cooling operation may include that some of the refrigerant liquid is not evaporated in the second heat exchanger 210 provided in the air conditioning space. In other words, the first superheat less than the first reference value during the cooling operation may indicate that the amount of refrigerant passing through the second heat exchanger 210 is excessive.

Accordingly, the air conditioner 1 may reduce the amount of refrigerant passing through the second heat exchanger 210 to decrease the heat absorbed while the refrigerant liquid evaporates in the second heat exchanger 210.

For example, the processor 190 may control the first expansion valve 131 and/or the second expansion valve 132 to reduce the amount of refrigerant circulating through the refrigerant circuit. The processor 190 may reduce the opening ratio of the first expansion valve 131 and/or the second expansion valve 132.

As described above, the air conditioner 1 may adjust the amount of refrigerant circulating through the refrigerant circuit based on the pressure and temperature of the refrigerant gas drawn into the compressor 110. Accordingly, the air conditioner 1 may suppress or prevent the refrigerant liquid from being drawn into the compressor 110, and also suppress or prevent the cooling efficiency of the air conditioner 1 from decreasing.

Figure 6:
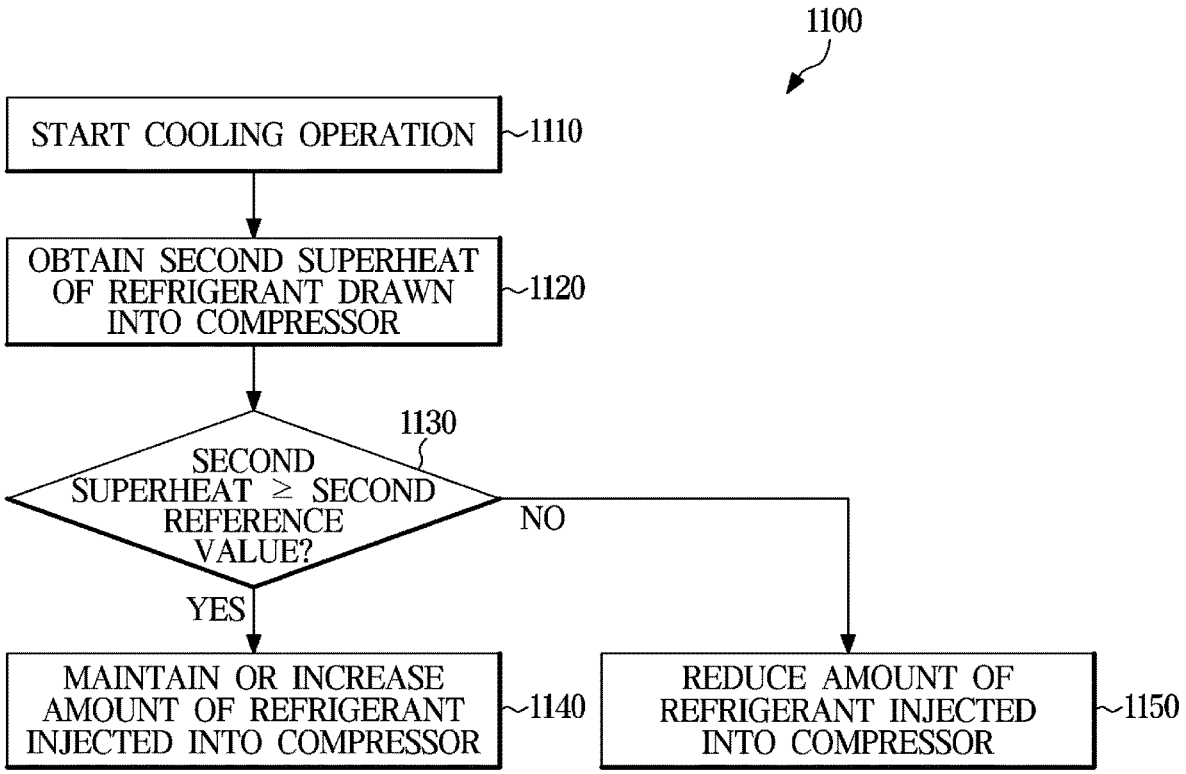
FIG. 6 is a flowchart illustrating an example method of controlling the amount of refrigerant injected into a compressor during a cooling operation of an air conditioner according to various embodiments.

FIG. 6 is a flowchart illustrating an example method of controlling the amount of refrigerant injected into a compressor during a cooling operation of an air conditioner according to various embodiments.

With reference to FIG. 6, a method of controlling the amount of refrigerant injected into the compressor 110 during a cooling operation is described.

The air conditioner 1 may start a cooling operation (1110).

Operation 1110 may be the same as or similar to operation 1010 illustrated in FIG. 4.

For example, some of the refrigerant liquid discharged from the first heat exchanger 120 may be guided to the third expansion valve 133 of the fourth flow path 164 at a branch point. Some of the refrigerant liquid may be expanded in the third expansion valve 133 and may be evaporated while passing through the sub-cooler 150. The evaporated refrigerant gas may be injected into the compressor 110.

The air conditioner 1 may obtain a second superheat (injection superheat) of the refrigerant gas injected into the compressor 110 during the cooling operation (1120).

The superheat of the refrigerant gas may represent a difference between an actual temperature of the refrigerant gas and a saturation temperature of the refrigerant gas.

The actual temperature of the refrigerant gas injected into the compressor 110 through the fourth flow path 164 may be measured by the injection temperature sensor 176. The injection temperature sensor 176 may be arranged between the sub-cooler 150 and the compressor 110 on the fourth flow path 164 to measure a temperature (hereinafter referred to as "injection temperature") of the refrigerant gas evaporated in the sub-cooler 150. The injection temperature sensor 176 may provide the processor 190 with an electrical signal corresponding to the injection temperature, and the processor 190 may identify the injection temperature based on an output signal of the injection temperature sensor 176.

The saturation temperature of the refrigerant gas injected into the compressor 110 through the fourth flow path 164 may be measured by the branch temperature sensor 175. The branch temperature sensor 175 may be arranged between the sub-cooler 150 and the third expansion valve 133 of the fourth flow path 164 to measure a temperature (hereinafter referred to as "branch temperature") of the refrigerant liquid decompressed by the third expansion valve 133.

The refrigerant liquid may be cooled while being decompressed by the third expansion valve 133. In response to a temperature of the cooled refrigerant liquid reaching the saturation temperature of the refrigerant, some of the refrigerant liquid evaporates and a temperature of the refrigerant (a mixture of refrigerant liquid and refrigerant gas) may maintain the saturation temperature. Accordingly, the temperature of the refrigerant liquid decompressed by the third expansion valve 133 may be approximately equal to the saturation temperature of the refrigerant. The processor 190 may identify the saturation temperature of the refrigerant based on an output signal of the branch temperature sensor 175.

The processor 190 may identify the second superheat of the refrigerant gas based on a difference between the saturation temperature (branch temperature) and the injection temperature of the refrigerant gas injected into the compressor 110.

The air conditioner 1 may identify whether the second superheat is greater than or equal to a second reference value during the cooling operation (1130).

The superheat of the refrigerant gas injected into the compressor 110 may represent the difference between the saturation temperature (branch temperature) of the refrigerant gas and the actual temperature (injection temperature) of the refrigerant gas injected into the compressor 110.

In this instance, because the refrigerant gas is condensed at a temperature lower than the saturation temperature, the superheat of the refrigerant gas may be a positive number greater than "0".

In order to suppress or prevent the refrigerant liquid from being injected into the compressor 110, the air conditioner 1 may control the refrigerant circuit to maintain the second superheat of the refrigerant gas injected into the compressor 110 at a positive value close to "0".

For example, the processor 190 may compare the second superheat of the refrigerant gas injected into the compressor 110 with the second reference value, and identify whether the second superheat is greater than or equal to the second reference value. Here, the second reference value may be a positive number close to "0". For example, the second reference value may be a value between 1 and 4.

In response to the second superheat being greater than or equal to the second reference value (Yes in operation 1130), the air conditioner 1 may maintain or increase the amount of refrigerant injected into the compressor 110 (1140).

The second superheat greater than or equal to the second reference value during the cooling operation may indicate that the refrigerant liquid is further heated after the refrigerant liquid evaporates in the fourth flow path 164 of the sub-cooler 150. Accordingly, the air conditioner 1 may increase the amount of refrigerant passing through the fourth flow path 164 to increase the heat absorbed while the refrigerant liquid evaporates in the fourth flow path 164 of the sub-cooler 150.

The third expansion valve 133 may adjust or control the amount of refrigerant passing through the fourth flow path 164. For example, the processor 190 may control the third expansion valve 133 to increase or maintain the amount of refrigerant passing through the fourth flow path 164. The processor 190 may increase an opening ratio of the third expansion valve 133 or maintain the opening ratio at a maximum opening ratio.

In response to the second superheat being less than the second reference value (No in operation 1130), the air conditioner 1 may reduce the amount of refrigerant circulating through the refrigerant circuit (1150).

The second superheat less than the second reference value during the cooling operation may indicate that some of the refrigerant liquid is not evaporated in the fourth flow path 164 of the sub-cooler 150 provided in an air conditioning space. Accordingly, the air conditioner 1 may reduce the amount of refrigerant passing through the fourth flow path 164 to reduce the heat absorbed while the refrigerant liquid evaporates in the fourth flow path 164 of the sub-cooler 150.

For example, the processor 190 may control the third expansion valve 133 to reduce the amount of refrigerant passing through the fourth flow path 164. The processor 190 may reduce the opening ratio of the third expansion valve 133.

As described above, the air conditioner 1 may adjust the amount of refrigerant injected into the compressor 110 based on the temperature of the refrigerant flowing into the sub-cooler 150 and the temperature of the refrigerant flowing out of the sub-cooler 150. Accordingly, the air conditioner 1 may suppress or prevent the refrigerant liquid from being injected into the compressor 110, and may also efficiently suppress or prevent the compressor 110 from overheating.

Figure 7:
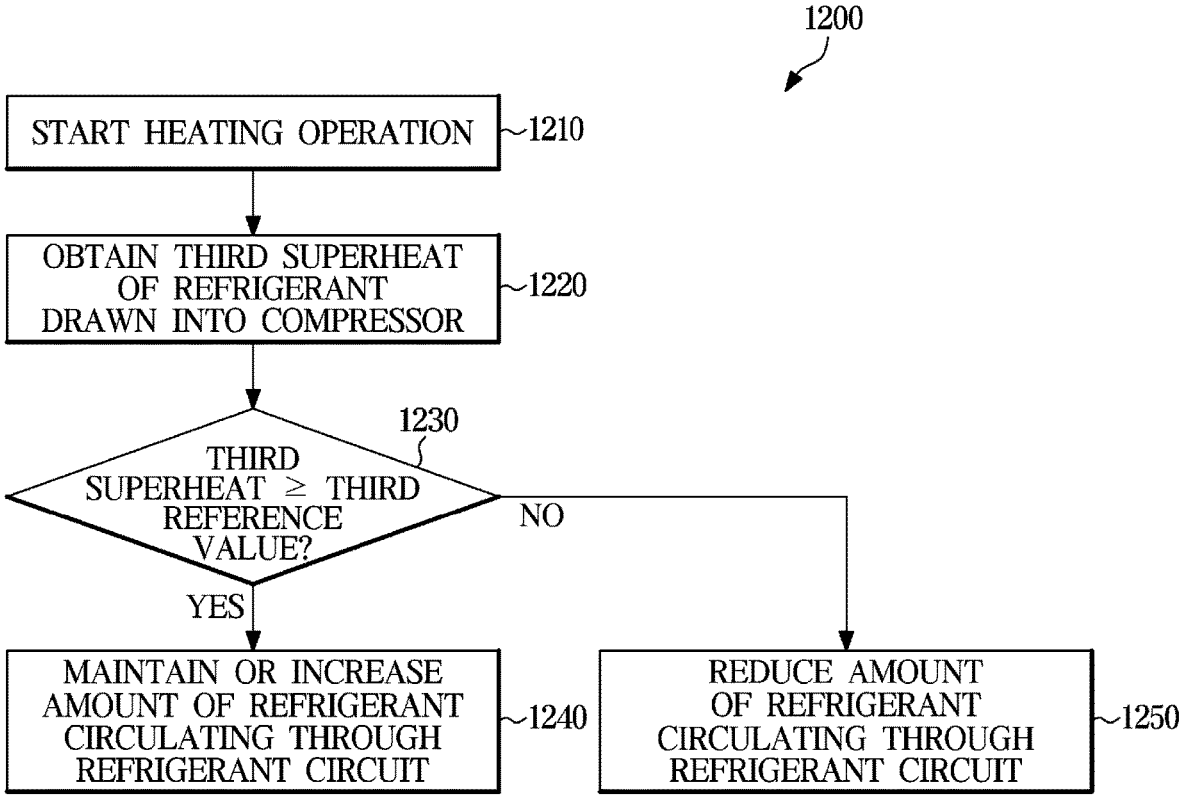
FIG. 7 is a flowchart illustrating an example method of controlling the amount of refrigerant circulating through a refrigerant circuit during a heating operation of an air conditioner according to various embodiments.
Figure 8:
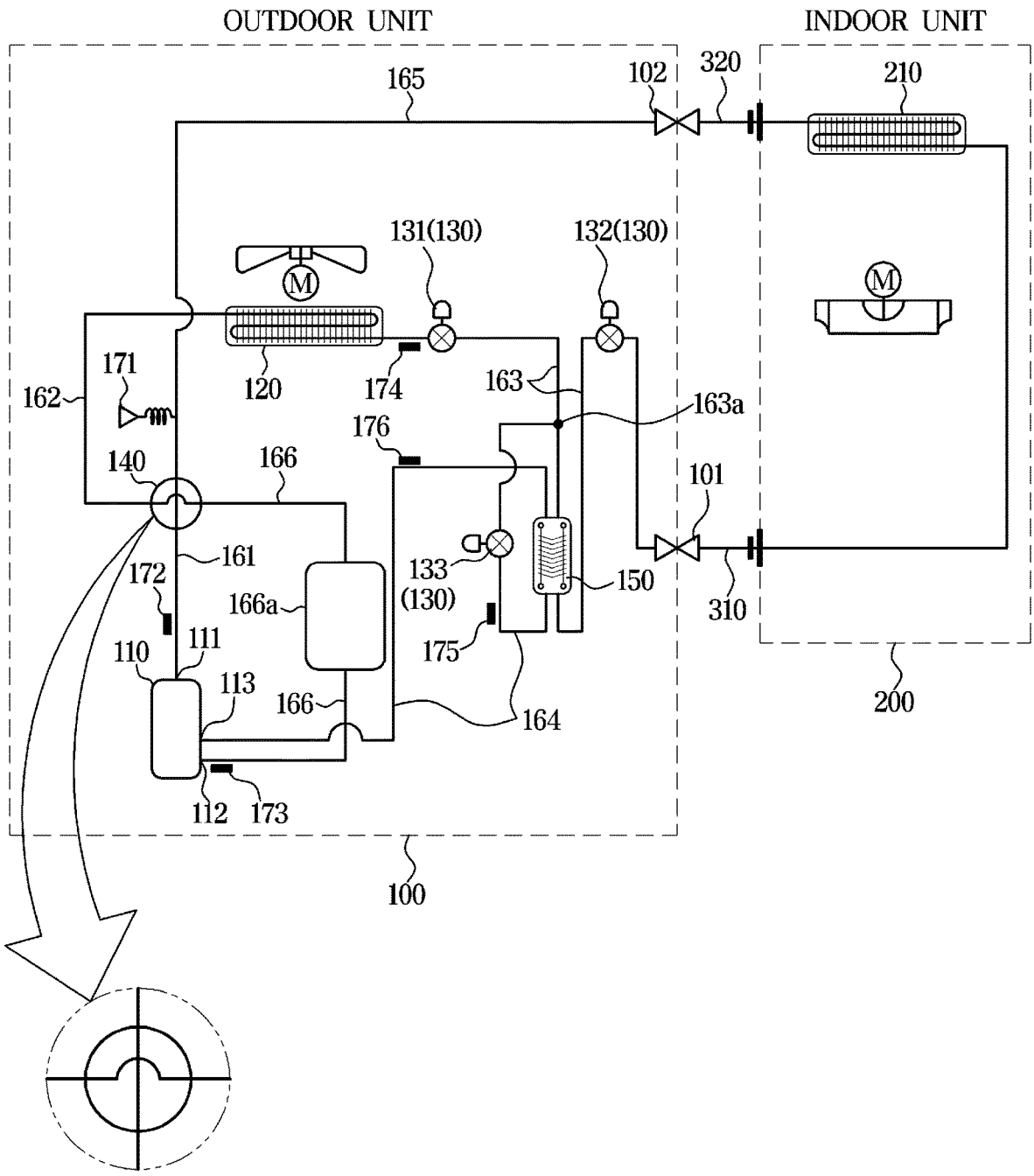
FIG. 8 is a diagram illustrating an example refrigerant circuit during a heating operation of an air conditioner according to various embodiments.

FIG. 7 is a flowchart illustrating an example method of controlling the amount of refrigerant circulating through a refrigerant circuit during a heating operation of an air conditioner according to various embodiments. FIG. 8 is a diagram illustrating an example refrigerant circuit during a heating operation of an air conditioner according to various embodiments.

With reference to FIG. 7 and FIG. 8, a method of controlling the amount of refrigerant circulating through the refrigerant circuit during a heating operation is described.

The air conditioner 1 may start a heating operation (1210).

The air conditioner 1 may obtain a user input through a user interface provided in the indoor unit 200. For example, the air conditioner 1 may start the heating operation when a user selects the heating operation or selects a target temperature higher than a room temperature.

For heating operation, the processor 190 of the outdoor unit 100 may switch a position of the flow path switching valve 140. The processor 190 may switch the position of the flow path switching valve 140 to a third position to connect the first flow path 161 to the fifth flow path 165 and connect the sixth flow path 166 to the second flow path 162, as shown in FIG. 8.

In addition, the processor 190 may control the motor drive 114 to supply a driving current to the compression motor 115 of the compressor 110 for heating operation.

As shown in FIG. 8, the refrigerant gas compressed by the compressor 110 may flow into the second heat exchanger 210 of the indoor unit 200 through the flow path switching valve 140 in the third position and the gas pipe 320. The refrigerant gas may be condensed in the second heat exchanger 210, and a refrigerant liquid may be discharged from the second heat exchanger 210.

The refrigerant liquid discharged from the second heat exchanger 210 may pass through the sub-cooler 150 through the liquid pipe 310, and may be decompressed in the first expansion valve 131. The refrigerant liquid may be guided to the first heat exchanger 120.

The refrigerant liquid may be evaporated in the first heat exchanger 120. The refrigerant gas evaporated in the first heat exchanger 120 may be drawn into the compressor 110 through the flow path switching valve 140 in the third position.

The air conditioner 1 may obtain a third superheat (intake superheat) of the refrigerant gas drawn into the compressor 110 during the heating operation (1220).

The superheat of the refrigerant gas may represent a difference between an actual temperature of the refrigerant gas and a saturation temperature of the refrigerant gas.

The actual temperature of the refrigerant gas drawn into the compressor 110 through the sixth flow path 166 may be measured by the intake temperature sensor 173. The intake temperature sensor 173 may provide the processor 190 with an electrical signal corresponding to the intake temperature, and the processor 190 may identify the intake temperature based on an output signal of the intake temperature sensor 173.

The saturation temperature of the refrigerant gas drawn into the compressor 110 through the sixth flow path 166 may be measured by the liquid temperature sensor 174. The liquid temperature sensor 174 may be arranged between the first heat exchanger 120 and the first expansion valve 131 of the third flow path 163 to measure a temperature (hereafter referred to as "liquid temperature") of the refrigerant liquid decompressed by the first expansion valve 131.

The refrigerant liquid may be cooled while being decompressed by the first expansion valve 131. Some of the cooled refrigerant liquid may evaporate and a temperature of a mixture of refrigerant liquid and refrigerant gas may be maintained at the saturation temperature. Accordingly, the temperature of the refrigerant liquid decompressed by the first expansion valve 131 may be approximately equal to the saturation temperature of the refrigerant. The processor 190 may identify the saturation temperature of the refrigerant based on an output signal of the liquid temperature sensor 174.

The processor 190 may identify the third superheat of the refrigerant gas based on a difference between the saturation temperature (liquid temperature) and the intake temperature of the refrigerant gas drawn into the compressor 110.

The air conditioner 1 may identify whether the third superheat is greater than or equal to a third reference value during the heating operation (1230).

Operation 1230 may be the same as or similar to operation 1030 illustrated in FIG. 4. For example, the processor 190 may identify whether the third superheat is greater than or equal to the third reference value, and the third reference value may be a positive number greater than "0."

In response to the third superheat being greater than or equal to the third reference value (Yes in operation 1230), the air conditioner 1 may maintain or increase the amount of refrigerant circulating through the refrigerant circuit (1240).

Operation 1240 may be the same as or similar to operation 1040 illustrated in FIG. 4. For example, the processor 190 may increase an opening ratio of the first expansion valve 131 and/or the second expansion valve 132 or maintain the opening ratio at a maximum opening ratio to increase the amount of refrigerant circulating through the refrigerant circuit.

In response to the third superheat being less than the third reference value (No in operation 1230), the air conditioner 1 may reduce the amount of refrigerant circulating through the refrigerant circuit (1250).

Operation 1250 may be the same as or similar to operation 1050 illustrated in FIG. 4. For example, the processor 190 may reduce the opening ratio of the first expansion valve 131 and/or the second expansion valve 132.

As described above, the air conditioner 1 may adjust the amount of refrigerant circulating through the refrigerant circuit, based on the temperature of the refrigerant gas and the temperature of the decompressed/cooled refrigerant liquid. Accordingly, the air conditioner 1 may suppress or prevent the refrigerant liquid from being drawn into the compressor 110, and also suppress or prevent a cooling efficiency of the air conditioner 1 from decreasing.

Figure 9:
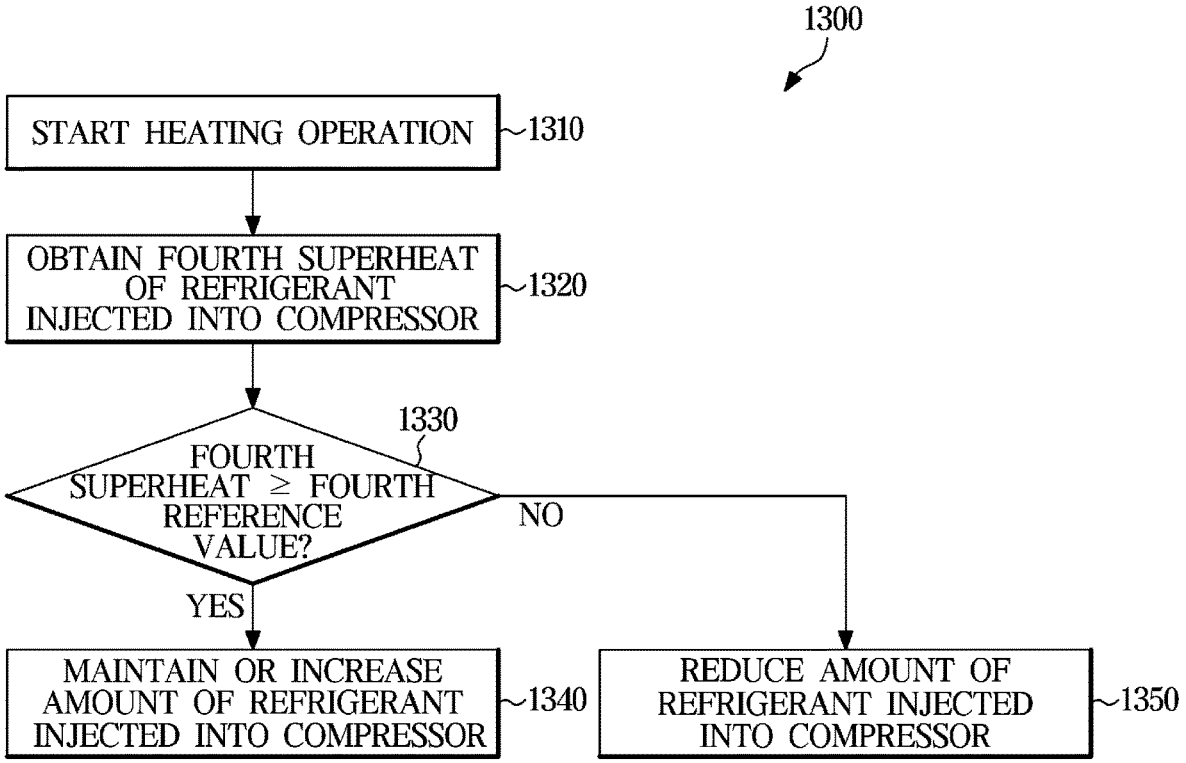
FIG. 9 is a flowchart illustrating an example method of controlling the amount of refrigerant injected into a compressor during a heating operation of an air conditioner according to various embodiments.

FIG. 9 is a flowchart illustrating an example method of controlling the amount of refrigerant injected into a compressor during a heating operation of an air conditioner according to various embodiments.

The air conditioner 1 may start a heating operation (1310).

Operation 1310 may be the same as or similar to operation 1210 illustrated in FIG. 7.

For example, some of the refrigerant liquid discharged from the first heat exchanger 120 may be guided to the third expansion valve 133 of the fourth flow path 164 at a branch point. Some of the refrigerant liquid may be expanded in the third expansion valve 133 and may be evaporated while passing through the sub-cooler 150. The evaporated refrigerant gas may be injected into the compressor 110.

The air conditioner 1 may obtain a fourth superheat (discharge superheat) of the refrigerant gas injected into the compressor 110 during the heating operation (1320).

For example, in a case where the heating operation is performed while an outdoor temperature is low, high heating performance or heating efficiency may be required. In order to improve the heating performance or heating efficiency of the air conditioner 1, the air conditioner 1 may perform flash injection to inject a refrigerant in which refrigerant liquid and refrigerant gas are mixed into the compressor 110. In response to the refrigerant liquid and the refrigerant gas being injected into the compressor 110 together, the amount of refrigerant injected into the compressor 110 increases, thereby further preventing and/or reducing overheating of the compressor 110 and improving an efficiency of the compressor 110.

However, in a case where a ratio of refrigerant liquid to the refrigerant injected into the compressor 110 is extremely high, the compressor 110 may malfunction. In order to prevent and/or inhibit the compressor 110 from malfunctioning, the air conditioner 1 may maintain the ratio of the refrigerant liquid below a predetermined ratio.

In order to control the ratio of refrigerant liquid to the refrigerant injected into the compressor 110, the air conditioner 1 may use a superheat (discharge superheat) of the refrigerant gas discharged from the compressor 110. The air conditioner 1 may control the amount of refrigerant injected into the compressor 110 based on the discharge superheat.

The superheat of the refrigerant gas may represent a difference between an actual temperature of the refrigerant gas and a saturation temperature of the refrigerant gas.

The actual temperature of the refrigerant gas discharged from the compressor 110 may be measured by the discharge temperature sensor 172. The discharge temperature sensor 172 may be arranged on the first flow path 161 connected to the outlet 111 of the compressor 110 to measure a temperature (hereinafter referred to as "discharge temperature") of the refrigerant gas discharged from the compressor 110. The discharge temperature sensor 172 may provide the processor 190 with an electrical signal corresponding to the discharge temperature, and the processor 190 may identify the discharge temperature based on an output signal of the discharge temperature sensor 172.

The saturation temperature of the refrigerant gas discharged from the compressor 110 through the first flow path 161 may be calculated based on an output signal of the pressure sensor 171. The pressure sensor 171 may be arranged on the fifth flow path 165 between the flow path switching valve 140 and the second refrigerant port 102 to measure a pressure (hereinafter referred to as "pressure of the fifth flow path") of the refrigerant gas passing through the fifth flow path 165. Also, because the first flow path 161 is connected to the fifth flow path 165 by the flow path switching valve 140 in the third position, the pressure measured by the pressure sensor 171 may be approximately the same as a pressure (hereinafter referred to as "pressure of the first flow path") of the refrigerant gas in the first flow path 161.

In addition, in the memory 191, a table including a plurality of pressure values of refrigerant gas and a plurality of saturation temperatures respectively corresponding to the plurality of pressure values of the refrigerant gas may be stored in advance. The processor 190 may identify a saturation temperature corresponding to a discharge pressure with reference to the table stored in the memory 191. In other words, the processor 190 may identify the saturation temperature of the refrigerant gas discharged from the compressor 110.

The processor 190 may identify the fourth superheat of the refrigerant gas based on a difference between the saturation temperature and the discharge temperature of the refrigerant gas discharged from the compressor 110.

The air conditioner 1 may identify whether the fourth superheat is greater than or equal to a fourth reference value during the heating operation (1330).

The superheat (hereinafter referred to as "discharge superheat") of the refrigerant gas discharged from the compressor 110 may depend on the amount of refrigerant liquid injected into the compressor 110. For example, in response to an increase in the amount of refrigerant liquid injected into the compressor 110, the discharge superheat may decrease. In response to a decrease in the amount of refrigerant liquid injected into the compressor 110, the discharge superheat may increase. Using the above-described relationship between the discharge superheat and the amount of refrigerant liquid, the fourth superheat may be set experimentally or empirically to allow the compressor 110 to operate at a maximum compression efficiency without damage to the compressor 110.

In response to the fourth superheat being greater than or equal to the fourth reference value (Yes in operation 1330), the air conditioner 1 may maintain or increase the amount of refrigerant injected into the compressor 110 (1340).

Operation 1340 may be the same as or similar to operation 1140 illustrated in FIG. 6.

The fourth superheat greater than or equal to the fourth reference value during the heating operation may indicate that the amount of refrigerant liquid injected into the compressor 110 is insufficient. Accordingly, the air conditioner 1 may increase the amount of refrigerant passing through the fourth flow path 164. For example, the processor 190 may increase an opening ratio of the third expansion valve 133 or maintain the opening ratio at a maximum opening ratio to increase or maintain the amount of refrigerant passing through the fourth flow path 164.

In response to the fourth superheat being less than the fourth reference value (No in operation 1330), the air conditioner 1 may reduce the amount of refrigerant injected into the compressor 110 (1350).

The fourth superheat greater than or equal to the fourth reference value during the heating operation may indicate that the amount of refrigerant liquid injected into the compressor 110 is excessive. Accordingly, the air conditioner 1 may reduce the amount of refrigerant passing through the fourth flow path 164. For example, the processor 190 may reduce the opening ratio of the third expansion valve 133 to reduce the amount of refrigerant passing through the fourth flow path 164.

As described above, the air conditioner 1 may adjust the amount of refrigerant injected into the compressor 110 based on the pressure and temperature of the refrigerant gas discharged from the compressor 110. Accordingly, the air conditioner 1 may suppress or prevent the refrigerant liquid from being injected into the compressor 110, and may also efficiently suppress or prevent the compressor 110 from overheating.

Figure 10:
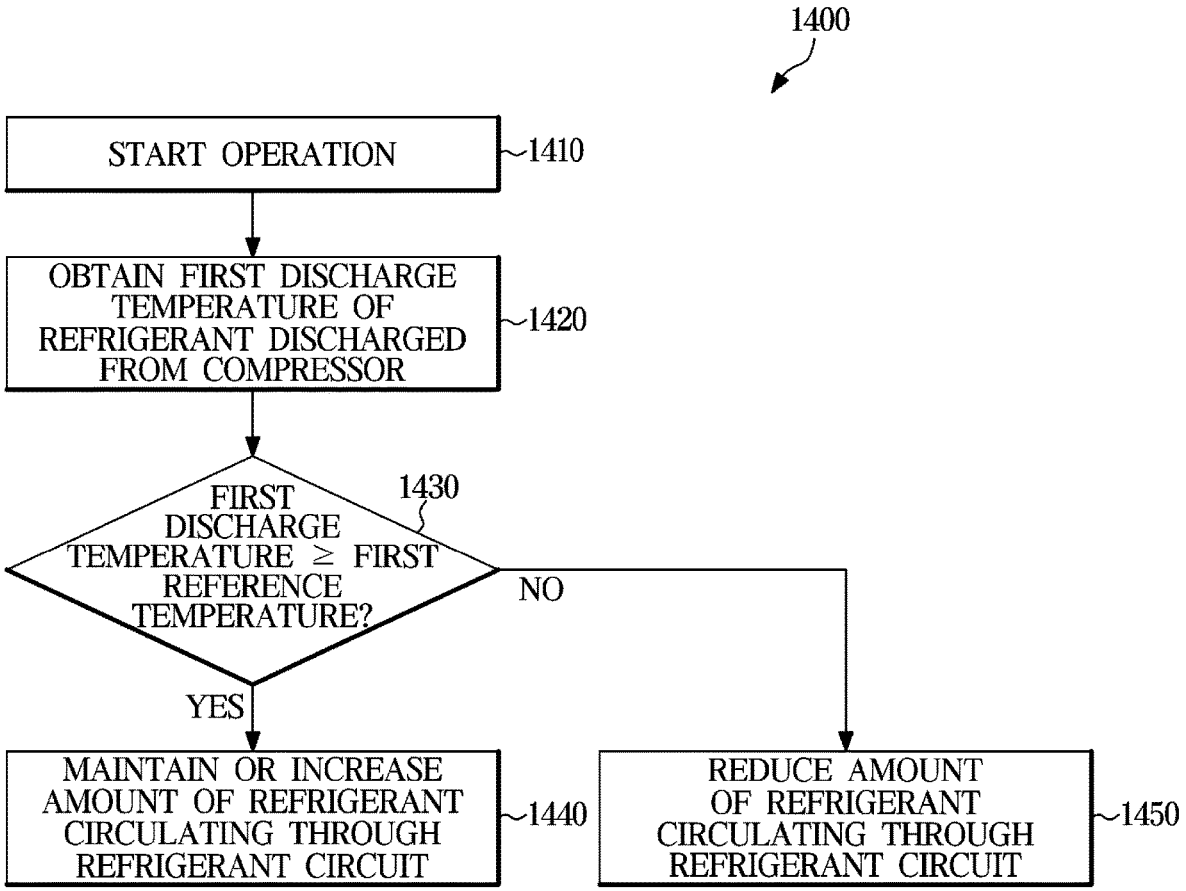
FIG. 10 is a flowchart illustrating an example method of controlling the amount of refrigerant circulating through a refrigerant circuit during a cooling and heating operation of an air conditioner according to various embodiments.

FIG. 10 is a flowchart illustrating an example method of controlling the amount of refrigerant circulating through a refrigerant circuit during a cooling and heating operation of an air conditioner according to various embodiments.

With reference to FIG. 10, a method 1400 of controlling the amount of refrigerant circulating through a refrigerant circuit during cooling and heating operations is described.

The air conditioner 1 may start an operation (1410).

The air conditioner 1 may obtain a user input for a cooling operation or a heating operation through a user interface provided in the indoor unit 200.

The processor 190 may switch the flow path switching valve 140 to the second position for the cooling operation or switch the flow path switching valve 140 to the third position for heating operation. In addition, the processor 190 may control the motor drive 114 to supply a driving current to the compression motor 115 of the compressor 110 for cooling operation.

The air conditioner 1 may obtain a first discharge temperature of the refrigerant discharged from the compressor 110 (1420).

The first discharge temperature of the refrigerant discharged from the compressor 110 may be measured by the discharge temperature sensor 172. The discharge temperature sensor 172 may provide the processor 190 with an electrical signal corresponding to the measured first discharge temperature, and the processor 190 may identify the first discharge temperature based on an output signal of the discharge temperature sensor 172.

The air conditioner 1 may identify whether the first discharge temperature is greater than or equal to a first reference temperature (1430).

For example, the processor 190 may compare the first discharge temperature, measured by the discharge temperature sensor 172, with the first reference temperature. The first reference temperature may be set experimentally or empirically to allow the compressor 110 to operate at a maximum compression efficiency without overheating the compressor 110.

In response to the first discharge temperature being greater than or equal to the first reference temperature (Yes in operation 1430), the air conditioner 1 may maintain or increase the amount of refrigerant circulating through the refrigerant circuit (1440).

The first discharge temperature greater than or equal to the first reference temperature may indicate that a temperature of the refrigerant gas drawn into the compressor 110 is high and the amount of refrigerant circulating through the refrigerant circuit is insufficient. Accordingly, the air conditioner 1 may increase the amount of refrigerant circulating through the refrigerant circuit. For example, the processor 190 may increase an opening ratio of the first expansion valve 131 and/or the second expansion valve 132 or maintain the opening ratio at a maximum opening ratio.

In response to the first discharge temperature being lower than the first reference temperature (No in operation 1430), the air conditioner 1 may reduce the amount of refrigerant circulating through the refrigerant circuit (1450).

The first discharge temperature lower than the first reference temperature may indicate that the temperature of the refrigerant gas drawn into the compressor 110 is low and the amount of refrigerant circulating through the refrigerant circuit is excessive. Accordingly, the air conditioner 1 may reduce the amount of refrigerant circulating through the refrigerant circuit. For example, the processor 190 may reduce the opening ratio of the first expansion valve 131 and/or the second expansion valve 132.

As described above, the air conditioner 1 may adjust the amount of refrigerant circulating through the refrigerant circuit based on the temperature of the refrigerant gas discharged from the compressor 110. Accordingly, the air conditioner 1 may suppress or prevent the compressor 110 from overheating and the compression efficiency of the compressor 110 from decreasing.

Meanwhile, the disclosed embodiments may be implemented in the form of a recording medium that stores instructions executable by a computer. The instructions may be stored in the form of program codes, and when executed by a processor, the instructions may create a program module to perform operations of the disclosed embodiments. The recording medium may be implemented as a computer-readable recording medium.

The computer-readable recording medium may include all kinds of recording media storing instructions that may be interpreted by a computer. For example, the computer-readable recording medium may be a Read Only Memory (ROM), a Random Access Memory (RAM), a magnetic tape, a magnetic disk, a flash memory, an optical data storage device, etc.

The machine-readable storage medium may be provided in the form of a non-transitory storage medium. Here, when a storage medium is referred to as "non-transitory," it may be understood that the storage medium is tangible and may not include a signal (e.g., an electromagnetic wave), but rather that data is semi-permanently or temporarily stored in the storage medium. For example, a "non-transitory storage medium" may include a buffer in which data is temporarily stored.

According to an embodiment, the methods according to the various embodiments disclosed herein may be provided in a computer program product. The computer program product may be traded between a seller and a buyer as a product. The computer program product may be distributed in the form of a machine-readable storage medium (e.g., compact disc read only memory (CD-ROM)), or may be distributed through an application store (e.g., Play Store™) online. In the case of online distribution, at least a portion of the computer program product may be stored at least semi-permanently or may be temporarily generated in a storage medium, such as a memory of a server of a manufacturer, a server of an application store, or a relay server.

Although embodiments of the present disclosure have been described with reference to the accompanying drawings, those skilled in the art will appreciate that the disclosed concepts may be embodied in different forms without departing from the scope and spirit of the disclosure, and should not be construed as limited to the embodiments set forth herein. It will also be understood that any of the embodiment(s) described herein may be used in conjunction with any other embodiment(s) described herein.

What is claimed is:

1. An air conditioner, comprising:

a compressor;

a flow path switching valve;

a first flow path connecting an outlet of the compressor to the flow path switching valve;

a first heat exchanger;

a second flow path connecting the first heat exchanger to the flow path switching valve;

a first refrigerant port fluidly connected to an indoor unit;

a third flow path extending from the first heat exchanger to the first refrigerant port;

a sub-cooler provided on the third flow path;

a first expansion valve provided between the first heat exchanger and the sub-cooler on the third flow path;

a second expansion valve provided between the sub-cooler and the first refrigerant port on the third flow path;

a fourth flow path branched from a branch point of the third flow path, passing through the sub-cooler, and extending to an inlet of the compressor;

a third expansion valve provided between the sub-cooler and the branch point on the fourth flow path;

a second refrigerant port fluidly connected to the indoor unit;

a fifth flow path connecting the second refrigerant port to the flow path switching valve;

a sixth flow path connecting the flow path switching valve to an intake port of the compressor;

a pressure sensor provided on the fifth flow path;

a first temperature sensor provided on the sixth flow path; and at least one processor, comprising processing circuitry, operatively connected to the compressor, the flow path switching valve, the first expansion valve, the second expansion valve, the third expansion valve, the pressure sensor, and the first temperature sensor, wherein the at least one processor, individually and/or collectively, is configured to:

control the flow path switching valve to connect the first flow path and the second flow path and connect the sixth flow path and the fifth flow path, based on an input for a cooling operation, and control at least one expansion valve of the first expansion valve or the second expansion valve based on an output of the pressure sensor and an output of the first temperature sensor.

2. The air conditioner of claim 1, wherein at least one processor, individually and/or collectively, is configured to:

identify a first saturation temperature of a refrigerant of the fifth flow path based on the output of the pressure sensor, identify a first measurement temperature of a refrigerant of the sixth flow path based on the output of the first temperature sensor, and control the at least one expansion valve based on the first saturation temperature and the first measurement temperature.

3. The air conditioner of claim 2, wherein at least one processor, individually and/or collectively, is configured to control the at least one expansion valve based on a comparison between a first reference value and a first difference between the first saturation temperature and the first measurement temperature.

4. The air conditioner of claim 3, wherein at least one processor, individually and/or collectively, is configured to:

increase an opening ratio of the at least one expansion valve based on the first difference being greater than or equal to the first reference value, and decrease the opening ratio of the at least one expansion valve based on the first difference being less than the first reference value.

5. The air conditioner of claim 1, further comprising:

a second temperature sensor provided between the third expansion valve and the sub-cooler on the fourth flow path; and a third temperature sensor provided between the sub-cooler and the inlet of the compressor on the fourth flow path, wherein at least one processor, individually and/or collectively, is configured to control the third expansion valve based on an output of the third temperature sensor and an output of the second temperature sensor.

6. The air conditioner of claim 5, wherein at least one processor, individually and/or collectively, is configured to:

identify a second saturation temperature of a refrigerant of the fourth flow path based on the output of the second temperature sensor, identify a second measurement temperature of the refrigerant of the fourth flow path based on the output of the third temperature sensor, and control the third expansion valve based on a difference between the second saturation temperature and the second measurement temperature.

7. The air conditioner of claim 6, wherein at least one processor, individually and/or collectively, is configured to control the third expansion valve based on a comparison between a second reference value and a second difference between the second saturation temperature and the second measurement temperature.

8. The air conditioner of claim 7, wherein at least one processor, individually and/or collectively, is configured to:

increase an opening ratio of the third expansion valve based on the second difference being greater than or equal to the second reference value, and decrease the opening ratio of the third expansion valve based on the second difference being less than the second reference value.

9. An air conditioner, comprising:

a compressor;

a flow path switching valve;

a first flow path connecting an outlet of the compressor to the flow path switching valve;

a first heat exchanger;

a second flow path connecting the first heat exchanger to the flow path switching valve;

a first refrigerant port fluidly connected to an indoor unit;

a third flow path extending from the first heat exchanger to the first refrigerant port;

a sub-cooler provided on the third flow path;

a first expansion valve provided between the first heat exchanger and the sub-cooler on the third flow path;

a second expansion valve provided between the sub-cooler and the first refrigerant port on the third flow path;

a fourth flow path branched from a branch point of the third flow path, passing through the sub-cooler, and extending to an inlet of the compressor;

a third expansion valve provided between the sub-cooler and the branch point on the fourth flow path;

a second refrigerant port fluidly connected to the indoor unit;

a fifth flow path connecting the second refrigerant port to the flow path switching valve;

a sixth flow path connecting the flow path switching valve to an intake port of the compressor;

a first temperature sensor provided on the sixth flow path;

a second temperature sensor provided between the first expansion valve and the first heat exchanger on the third flow path; and at least one processor, comprising processing circuitry, operatively connected to the compressor, the flow path switching valve, the first expansion valve, the second expansion valve, the third expansion valve, the first temperature sensor, and the second temperature sensor, wherein the at least one processor, individually and/or collectively, is configured to:

control the flow path switching valve to connect the first flow path and the fifth flow path and connect the sixth flow path and the second flow path, based on an input for a heating operation, and control at least one expansion valve of the first expansion valve or the second expansion valve based on an output of the first temperature sensor and an output of the second temperature sensor.

10. The air conditioner of claim 9, wherein at least one processor, individually and/or collectively, is configured to:

identify a first saturation temperature of a refrigerant of the second flow path based on the output of the second temperature sensor, identify a first measurement temperature of a refrigerant of the sixth flow path based on the output of the first temperature sensor, and control the at least one expansion valve based on the first saturation temperature and the first measurement temperature.

11. The air conditioner of claim 10, wherein at least one processor, individually and/or collectively, is configured to control the at least one expansion valve based on a comparison between a first reference value and a first difference between the first saturation temperature and the first measurement temperature.

12. The air conditioner of claim 11, wherein at least one processor, individually and/or collectively, is configured to:

increase an opening ratio of the at least one expansion valve based on the first difference being greater than or equal to the first reference value, and decrease the opening ratio of the at least one expansion valve based on the first difference being less than the first reference value.

13. The air conditioner of claim 9, further comprising:

a pressure sensor provided on the fifth flow path; and a third temperature sensor provided on the first flow path, wherein at least one processor, individually and/or collectively, is configured to control the third expansion valve based on an output of the pressure sensor and an output of the third temperature sensor.

14. The air conditioner of claim 13, wherein at least one processor, individually and/or collectively, is configured to:

identify a second saturation temperature of a refrigerant of the fifth flow path based on the output of the pressure sensor, identify a second measurement temperature of a refrigerant of the first flow path based on the output of the third temperature sensor, and control the third expansion valve based on the second saturation temperature and the second measurement temperature.

15. The air conditioner of claim 14, wherein at least one processor, individually and/or collectively, is configured to control the third expansion valve based on a comparison between a second reference value and a second difference between the second saturation temperature and the second measurement temperature.

16. The air conditioner of claim 1, wherein the pressure sensor is configured to measure pressure of refrigerant discharged from the indoor unit when the air conditioner is performing a cooling operation.

17. The air conditioner of claim 13, wherein the pressure sensor is configured to measure pressure of refrigerant discharged from the indoor unit when the air conditioner is performing a cooling operation.

18. The air conditioner of claim 1, wherein the pressure sensor is provided on the fifth flow path between the flow path switching valve and the indoor unit.

19. The air conditioner of claim 13, wherein the pressure sensor is provided on the fifth flow path between the flow path switching valve and the indoor unit.

* * * * *